US008249477B2

(12) United States Patent
Masuda et al.

(10) Patent No.: US 8,249,477 B2
(45) Date of Patent: Aug. 21, 2012

(54) METHOD OF DETECTING POSITION OF TONER PATTERN, OPTICAL SENSOR, AND IMAGE FORMING APPARATUS

(75) Inventors: Koji Masuda, Kanagawa (JP); Takeshi Ueda, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 518 days.

(21) Appl. No.: 12/496,421

(22) Filed: Jul. 1, 2009

(65) Prior Publication Data

US 2010/0008686 A1 Jan. 14, 2010

(30) Foreign Application Priority Data

Jul. 9, 2008 (JP) ..... 2008-179623
Jan. 7, 2009 (JP) ..... 2009-001921

(51) Int. Cl.
*G03G 15/10* (2006.01)

(52) U.S. Cl. ..... 399/60; 399/72

(58) Field of Classification Search ..... 399/72, 399/60

See application file for complete search history.

(56) References Cited

U.S. PATENT DOCUMENTS

| | | | | |
|---|---|---|---|---|
| 5,875,051 | A | 2/1999 | Suzuki et al. | |
| 6,069,724 | A | 5/2000 | Hayashi et al. | |
| 6,075,638 | A | 6/2000 | Masuda | |
| 6,081,386 | A | 6/2000 | Hayashi et al. | |
| 6,384,949 | B1 | 5/2002 | Suzuki | |
| 6,456,314 | B1 | 9/2002 | Masuda | |
| 6,462,879 | B2 | 10/2002 | Masuda | |
| 6,496,214 | B1 | 12/2002 | Masuda et al. | |
| 6,686,946 | B2 | 2/2004 | Masuda et al. | |
| 6,693,654 | B2 * | 2/2004 | Shinohara | 347/116 |
| 6,717,606 | B2 | 4/2004 | Masuda | |
| 6,724,414 | B2 | 4/2004 | Masuda et al. | |
| 7,068,295 | B2 | 6/2006 | Masuda | |
| 7,450,283 | B2 | 11/2008 | Masuda | |
| 2005/0067944 | A1 | 3/2005 | Masuda et al. | |
| 2005/0093963 | A1 | 5/2005 | Masuda | |
| 2006/0024076 | A1 * | 2/2006 | Kato et al. | 399/49 |
| 2007/0146473 | A1 | 6/2007 | Masuda | |
| 2008/0075492 | A1 * | 3/2008 | Mestha et al. | 399/49 |
| 2008/0084594 | A1 | 4/2008 | Masuda | |
| 2009/0009838 | A1 | 1/2009 | Masuda | |
| 2009/0015896 | A1 | 1/2009 | Masuda | |

FOREIGN PATENT DOCUMENTS

| | | |
|---|---|---|
| JP | 2001-5247 | 1/2001 |
| JP | 2002-72612 | 3/2002 |
| JP | 2002-229280 | 8/2002 |
| JP | 2003-84530 | 3/2003 |
| JP | 2006-139179 | 6/2006 |
| JP | 4154272 | 7/2008 |

* cited by examiner

*Primary Examiner* — Walter L Lindsay, Jr.
*Assistant Examiner* — Roy Y Yi
(74) *Attorney, Agent, or Firm* — Dickstein Shapiro LLP

(57) ABSTRACT

A light-emitting unit includes M (M≧3) number of light-emitting elements. A light-receiving unit includes N (N≧3) number of light-receiving elements that receive a reflected light from at least one of a supporting member and a toner pattern. The toner pattern is formed on a surface of the supporting member. A detection light is emitted onto the supporting member from the light-emitting unit. A reflected light reflected from at least one of the supporting member and the toner pattern is received by the light-receiving unit. A position of the toner pattern on the supporting member is detected based on outputs of the light-receiving elements.

13 Claims, 13 Drawing Sheets

METHOD OF DETECTING POSITION OF TONER PATTERN, OPTICAL SENSOR, AND IMAGE FORMING APPARATUS

CROSS-REFERENCE TO RELATED APPLICATIONS

The present application claims priority to and incorporates by reference the entire contents of Japanese priority document 2008-179623 filed in Japan on Jul. 9, 2008 and Japanese priority document 2009-001921 filed in Japan on Jan. 7, 2009.

BACKGROUND OF THE INVENTION

1. Field of the Invention

The present invention relates to a technology for detecting a position of a toner pattern in an image forming apparatus.

2. Description of the Related Art

A variety of image forming apparatuses use toner to form images, i.e., they form toner images. Example of such image forming apparatuses are analog image forming apparatuses, digital image forming apparatuses, black-and-white copiers, color copiers, printers, plotters, facsimile machines, and, multifunction printers (MFPs).

An image that is formed by such image forming apparatuses is called "toner image". As is widely known, to form a desirable toner image on a recording medium, such as a paper sheet, it is necessary to control a position of the toner image accurately.

For example, in an image forming process of transferring the toner image from a photosensitive element having photoconductive properties onto the recording medium, and fixing the toner image to the recording medium, it is necessary to accurately transfer the toner image from the photosensitive element onto a target position (e.g., center position) on the recording medium.

The accurate transfer cannot be implemented without proper control over the position of the toner image on the photosensitive element with respect to the recording medium to which the toner image is to be transferred.

In a case of forming a multi-color image or a color image by superimposing the toner images in different colors on each other, especially, it is necessary to accurately superimpose, under the control over the position of each of the various-colored toner images, the toner images on each other.

Inaccurate position alignment among the toner images to be superimposed causes formation of an undesirable image due to registration mismatching in which timing to write the image is mismatched, incorrect magnification that causes an incorrect length of the image, color shift in which the relative positions of the toner images are not matched accurately with each other, etc.

To control the position of the toner image properly, a method of detecting a position of a toner image dedicated to a positional detection (hereinafter, "toner pattern") has been widely used. In the method, the toner pattern is formed first, and then the position of the toner pattern is detected from a change in a detection light reflected from the toner pattern (see, for example, Japanese Patent Application Laid-open No. 2003-84530, Japanese Patent Application Laid-open No. 2004-309292, and Japanese Patent Application Laid-open No. 2002-72612).

The toner pattern is formed under conditions the same as those under which a toner image as a product of the image formation (hereinafter, "product toner image") is formed. Therefore, it is possible to expect the position of the product toner image based on a result of the detected position of the toner pattern. The image formation conditions can be adjusted based on the result of the detected position of the toner pattern in such a manner that the product toner image is formed on a correct position.

An optical device that emits the detection light to the toner pattern and receives the detection light reflected from the toner pattern is called a reflection-type optical sensor.

Various types of reflection-type optical sensors are known in the art (see Japanese Patent Application Laid-open No. 2003-84530, Japanese Patent Application Laid-open No. 2004-309292, and Japanese Patent Application Laid-open No. 2002-72612).

A typical reflection-type optical sensor includes a light-emitting unit that emits the detection light and a light-receiving unit that receives the reflected light. The light emitting unit includes one or two light-emitting elements. The light-receiving unit includes one or two light-receiving elements (e.g., photodiodes (PDs) or phototransistors).

Light-emitting diodes (LEDs) are typically used as the light-emitting elements. Each of the LEDs emits the detection light of a spot size that is smaller than the toner pattern onto the toner pattern.

The toner pattern is formed, for example, on a transfer belt. The toner pattern moves as the transfer belt rotates. A direction in which the transfer belt moves due to the rotation is called a sub-direction, and a direction perpendicular to the sub-direction is called a main-direction. In a system in which electrostatic latent images are formed through optical scanning, the main-direction corresponds to the main-scanning direction, and the sub-direction corresponds to the sub-scanning direction.

An electrostatic latent image corresponding to the toner pattern is formed on a photosensitive member by optically scanning a surface of the photosensitive member with an electrostatic-latent-image forming unit, and the electrostatic latent image on the surface of the photosensitive member is then developed into the toner pattern. The toner pattern on the photosensitive member is then transferred onto the transfer belt, and is moved in the sub-direction with the rotation of the transfer belt. When the toner pattern enters a detection area, the toner pattern is exposed to a spot of the detection light from the reflection-type optical sensor.

The spot size of the detection light is typically about 2 millimeters (mm) to 3 mm in diameter.

A typical toner pattern for the position detection in the main-direction includes a parallel line pattern that is parallel to the main-direction and a slant line pattern that is inclined to the main-direction. The parallel line pattern and the slant line pattern are aligned in the sub-direction. The position of the toner pattern in the main-direction is detected from a difference between a time when the parallel line pattern is detected and a time when the slant line pattern is detected.

If a part of the spot of the detection light falls out of the line patterns, because of a large positional mismatch between the reflection-type optical sensor and the toner pattern in the main-direction, it is difficult to correctly detect the position of the toner pattern in the main-direction.

Assume, for example, that one light-emitting element emits one spot of the detection light, one light-receiving element receives the reflected light, and the position of the toner pattern (the line patterns) is detected from a difference between a specular reflection light and a diffuse reflection light. It is assumed that the detection light reflected from a region where there is no toner pattern is received as the specular reflection light. The detection light reflected from the toner pattern is received as the diffuse reflection light.

If a part of the spot of the detection light falls out of the line patterns, the part of the spot that falls on the region where there is no toner pattern is specularly reflected, and the specular reflection light is received at the light-receiving unit. On the other hand, the other part of the spot that falls within the line patterns is diffusely reflected.

To detect the line patterns from the intensity of the light received at the light-receiving elements without fail, it is required to suppress a value of the intensity to a threshold or lower by the diffuse reflection by the line patterns. Receiving of the specular reflection light from the region out of the line patterns increases the intensity of the received light, which may disadvantageously increase the intensity higher than the threshold. The specular reflection light can be a factor of a detection-signal error, i.e., the specular reflection light can affect an adverse effect on the detection of the correct position of the toner pattern.

To solve this problem, in the conventional technologies, the toner pattern (the line patterns) is formed to have a length in the main-direction from about 15 mm to about 20 mm long enough to receive the whole spot of the detection light without fail, thereby preventing a part of the spot of the detection light to fall out of the toner pattern.

In the image forming apparatus, especially, the color image forming apparatus, the detection of the position of the toner pattern is performed as a maintenance activity necessary for the image forming apparatus to perform the image forming process properly, and thereby form a high-quality image.

Because the detection of the position of the toner pattern is performed as the maintenance activity separated from a main activity, i.e., an image-forming process, the image formation as the main activity cannot be performed during the detection of the position of the toner pattern.

When the electrostatic latent image to be developed to the toner pattern is written by the optical scanning, time that it takes for the optical scanning is directly proportional to the size of the toner pattern. In other words, the larger the toner pattern is, the lower the operating efficiency of the image formation becomes.

Moreover, because a total amount of the toner is fixed, as an amount of the toner to be used for the toner pattern increases, an amount of the toner to be used for the product toner image decreases, disadvantageously. The larger the toner pattern is, the more the toner is consumed for the toner pattern.

In this manner, the conventional manner of detecting the position of the toner pattern have the two disadvantages, i.e., the low operating efficiency and the large toner-consumption amount for the toner pattern.

SUMMARY OF THE INVENTION

It is an object of the present invention to at least partially solve the problems in the conventional technology.

According to one aspect of the present invention, there is provided a method of detecting a position of a toner pattern in an image forming apparatus including a light-emitting unit that includes M number of light-emitting elements aligned in a single direction intersecting a first direction, where M is equal to or larger than three, and emits a detection light such that M number of light spots fall on a supporting member that makes a surface movement in the first direction with a distance between adjacent light spots in a second direction perpendicular to the first direction on the supporting member equal to or smaller than a length of a toner pattern in the second direction and a light-receiving unit that includes N number of light-receiving elements that receive a reflected light from at least one of the supporting member and the toner pattern, where N is equal to or larger than three, and aligned opposed to the supporting member in a single direction corresponding to the light-emitting units. The method includes forming the toner pattern on a surface of the supporting member; emitting the detection light onto the supporting member with the light-emitting unit; receiving a reflected light reflected from at least one of the supporting member and the toner pattern with the light-receiving unit; and detecting the position of the toner pattern on the supporting member based on outputs of the light-receiving elements.

Furthermore, according to another aspect of the present invention, there is provided an optical sensor for detecting a position of a toner pattern in an image forming apparatus. The optical sensor includes a light-emitting unit that includes M number of light-emitting elements aligned in a single direction which can be turned on and off individually or simultaneously, where M is equal to or larger than three, and emits a detection light onto a supporting member that makes a surface movement in a first direction on which a toner pattern is formed; and a light-receiving unit that includes N number of light-receiving elements that receive a reflected light from at least one of the supporting member and the toner pattern, where N is equal to or larger than three, and aligned opposed to the supporting member in a single direction corresponding to the light-emitting units.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
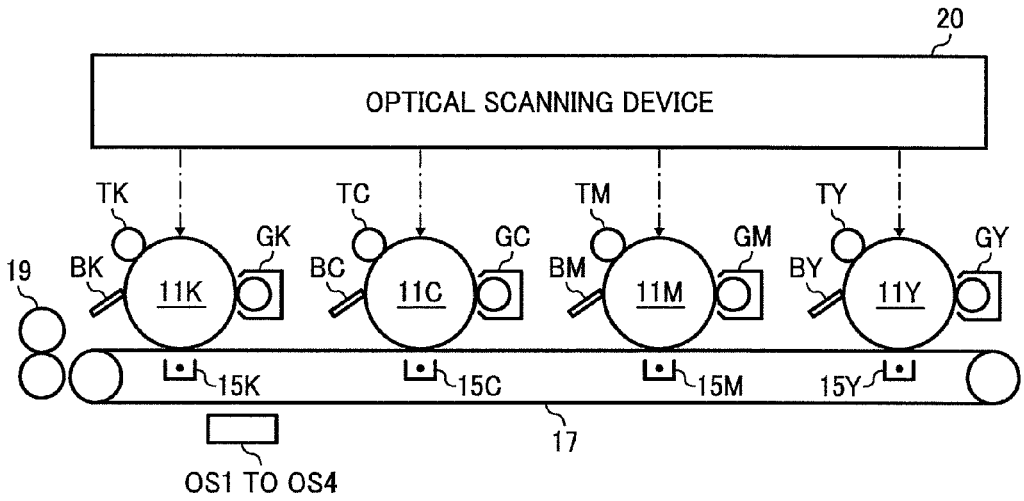
FIG. 1 is a schematic diagram of an image forming apparatus according to a first embodiment of the present invention.

Exemplary embodiments of the present invention are described in detail below with reference to the accompanying drawings.

The method of forming images with toner is used in the copiers, the printers, the plotters, the facsimile machines, the MFPs, etc. The method of forming images with toner includes the process of forming the electrostatic latent image and the process of developing the electrostatic latent image to the toner image.

The process of forming the electrostatic latent image is, more particularly, the process of exposing a photoconductive latent-image carrier with an evenly-charged surface to a light by the optical scanner or the like.

The toner pattern is a toner image for the positional detection. The toner pattern is formed by developing a predetermined electrostatic latent image. The toner pattern is on a supporting member in the measurement. In other words, the toner pattern is formed on the supporting member and then is moved in the sub-direction to the detection area.

As described above, the supporting member moves, in the detection of the position of the toner pattern, in the sub-direction, carrying the toner pattern thereon. The supporting member can be, for example, a latent-image carrier on which the electrostatic latent image is formed and a transfer belt or an intermediate transfer belt that is used to transfer the toner image.

In the following description, "predetermined toner pattern" means that a shape of the toner pattern is fixed.

Moreover, "single direction intersecting the sub-direction" includes the direction perpendicular to the sub-direction, i.e., the main-direction. "Distance between adjacent spots in a direction perpendicular to the sub-direction" means a distance between adjacent ones of spots formed on the surface of the supporting member aligned in the single direction perpendicular to the sub-direction, i.e., the main-direction when each of M-number of the light-emitting elements emits the detection light.

Moreover, "distance between adjacent spots" means not a distance between centers of the adjacent spots in the main-direction but, if the adjacent spots are not overlapped with each other, a distance between circumferences of the adjacent spots in the main-direction.

Specifically, it is assumed in the following description that M-number of the light-emitting elements is aligned in the main-direction at a 3-mm pitch, and the diameter of the circular spots is 2 mm. In other words, the distance between adjacent spots is 1 mm in the main-direction. This 1-mm interval between the adjacent spots is not exposed to the detection light.

However, if the toner pattern is larger than the distance between the adjacent spots (1 mm) in the main-direction, at least a part of the toner pattern is exposed to any of the spots when the toner pattern passes through an area on which the spots are aligned.

Therefore, it is enough for the toner pattern to be a little larger than 1 mm in the main-direction to be exposed to the spots of the detection light.

In other words, a toner pattern that is much smaller than the conventional toner pattern (15 mm to 25 mm) in width in the main-direction is sufficient.

The distance between the adjacent spots in the direction perpendicular to the sub-direction should be set smaller than the width of the toner pattern in the main-direction. That is, the distance between the adjacent spots can be smaller than 1 mm. Moreover, the adjacent spots can have an overlap in the main-direction. If the adjacent spots are overlapped, the distance between adjacent spots is a minus value, and the areas that are exposed to the spots of the detection light make a single area continuous in the main-direction. Therefore, the width of the toner pattern in the main-direction can be decreased infinitely, in principal.

Moreover, even if the spot size is smaller than the width of the toner pattern in the main-direction, it is possible to expose without fail the toner pattern to the detection light by adjusting the pitch between the adjacent spots in the main-direction to a value smaller than the width of the toner pattern in the main-direction. This is because, by the adjustment, the distance between the adjacent spots in the main-direction becomes smaller than the width of the toner pattern in the main-direction.

When the light-emitting unit emits the detection light to the supporting member, the detection light is reflected from the surface of the supporting member and/or the toner pattern, and is received by the light-receiving unit. The light-receiving unit includes three or more light-receiving elements. The intensity of the light received at each of the light-receiving elements varies depending on a positional relation between the spots of the detection lights and the toner pattern. The position of the toner pattern is detected accurately from outputs of the three or more light-receiving elements.

As is widely known, when the detection light strikes the toner pattern, the detection light is diffusely reflected. On the other hand, if the surface of the supporting member is specular and when the detection light strikes an area out of the toner pattern on a surface of the supporting member, the detection light is specularly reflected. The supporting member can be, for example, a photoconductive latent-image carrier.

Accordingly, the reflection property when the detection light strikes the area out of the toner pattern on the surface of the supporting member shows the specular reflection, while the reflection property when the detection light strikes the toner pattern shows the diffuse reflection. The difference in the reflection properties causes a variation of the intensities of the light received at the three or more light-receiving elements. Therefore, the position of the toner pattern can be detected from outputs of the three or more light-receiving elements.

If a transfer belt or an intermediate transfer belt is used as the supporting member, the surface of the supporting member reflects, in some cases, the detection light substantially specularly almost as a mirror surface reflects, and reflects, in other cases, the detection light diffusely. Even in a case that the surface of the supporting member reflects the detection light diffusely, if there is a difference between the diffuse reflection from the area out of the toner pattern and the diffuse reflection from the toner pattern, a distribution of the intensities of the light received at the plural light-receiving elements when the detection light is diffusely reflected from the area out of the toner pattern differs from the distribution when the detection light is diffusely reflected from the toner pattern.

Therefore, the position of the toner pattern can be detected from the distribution of the intensities of the light received at the plural light-receiving elements.

In the following description, it is assumed that both M, which is the number of the light-emitting elements that form the light-emitting unit, and N, which is the number of the light-receiving elements that form the light-emitting unit, are equal to or larger than three. It is allowable to set M equal to N (M=N) or different from N (M≠N).

Three or more LEDs aligned in a single direction can be used as the light-emitting elements of the light-emitting unit. If the LEDs have a lens function of collecting divergent light, the LEDs are arranged in such a manner that the detection light forms the spot with a desired size on the supporting member.

Alternatively, an LED array including three or more light-emitting elements can be used as the light-emitting unit. In this case, a light-collection optical system can be included in the light-emitting unit to collect the light emitted from the LED array.

PDs can be used as the light-receiving elements of the light-receiving unit. Alternatively, a PD array including three or more PDs (e.g., charge-coupled device (CCD) line sensor) can be used as the light-receiving unit.

The lower limit of M or N is, as described above, three. The upper limit of M or N is determined appropriately based on the practical size of the reflection-type optical sensor for the detection of the position of the toner pattern. The upper limit of M is, preferably, about 500. The upper limit of N can be several thousands as large as the number of PDs in the above-described PD array.

The light-emitting elements in total of M can be turned ON/OFF in various manners. For example, all the light-emitting elements turn ON/OFF, simultaneously. Alternatively, the light-emitting elements turn ON/OFF, sequentially one after another.

Still alternatively, the light-emitting elements are categorized into several groups. For example, even-number groups and odd-number groups are arranged alternately. The light-emitting elements turn ON/OFF sequentially on the group basis from a group arranged on an end.

M is equal to P·m. The light-emitting unit includes P-number of groups each including m-number of light-emitting elements. A first light-emitting element of each group turns ON/OFF, i.e., the first light-emitting elements in total of P turn ON/OFF, simultaneously. After that, a second light-emitting element of each group turns ON/OFF, i.e., the second light-emitting elements in total of P turn ON/OFF, simultaneously. This ON/OFF operation is repeated until m-th light-emitting element of each group turns ON/OFF.

The toner pattern is a toner image having a predetermined shape that is formed dedicated to the positional detection.

The toner pattern can be, for example, a homogenous toner image. Alternatively, as described later, the toner pattern can be a collection of toner images in the same color or different colors aligned in the sub-direction. The position of the toner pattern can be detected from a difference between time points when the toner images moving in the sub-direction are detected. Taking such case into consideration, a collection of the toner images can also be called "toner pattern".

The density of the toner image is not taken into consideration.

The light-emitting unit includes M-number of the light-emitting elements, where M≧3, aligned in a single direction. The light-emitting elements turn ON/OFF individually or simultaneously.

The light-receiving unit includes N-number of the light-receiving elements, where N≧3, aligned in a single direction corresponding to the light-emitting unit.

The light-emitting unit can include M-number of individual LEDs as the light-emitting elements. Alternatively, the light-emitting unit can be, for example, an LED array including M-number of LEDs. The light-receiving unit can include N-number of individual PDs as the light-receiving elements. Alternatively, the light-receiving unit can be, for example, a PD array including N-number of PDs.

In the following description "the light-emitting elements and the light-receiving elements are aligned in a single direction" includes not only the light-emitting elements and the light-receiving elements aligned in one line extending in the single direction but also the light-emitting elements and the light-receiving elements aligned in several parallel lines extending in the single direction. The several lines on which the light-emitting elements and the light-receiving elements are aligned are, of course, parallel to or intersecting the main-direction. The several lines are parallel to each other.

Image forming apparatuses can perform a method of detecting the position of the toner pattern according to any of embodiments of the present invention by using the reflection-type optical sensor.

In a method of detecting the position of the toner pattern according to an embodiment of the present invention, a plurality of patterns having a predetermined shape aligned in the main-direction at a pitch PT is formed as the toner pattern.

In another method of detecting the position of the toner pattern according to an embodiment of the present invention, a plurality of patterns having a predetermined shape aligned in the main-direction at the pitch PT is formed as the toner pattern. That is, the number of the patterns is two or larger.

One or more light-receiving elements as the light-receiving unit correspond to each of the light-emitting elements as the light-emitting unit. The corresponding light-receiving element is a set of the light-receiving elements corresponding to one light-emitting element. The number of the light-receiving elements forming the corresponding light-receiving element is one or more.

The corresponding light-receiving elements are aligned in the main-direction at a pitch DPT. The light-emitting elements are aligned at a pitch EPT. The pitch DPT is set equal to the pitch EPT.

In an embodiment of the present invention, M, which is the number of the light-emitting elements, is equal to or smaller than N, which is the number of the light-receiving elements.

One or more light-receiving elements correspond to one light-emitting element, thereby forming the corresponding light-receiving element.

In another embodiment of the present invention, N is smaller than M. Two or more light-emitting elements correspond to one light-receiving element, thereby forming a corresponding light-emitting element.

In an embodiment of the present invention, the lower limit of M and N is, as described above, three. The upper limit of M or N is determined appropriately based on the practical size of the reflection-type optical sensor for detecting the position of the toner pattern. The upper limit of M and N is, preferably, about 500.

In an embodiment of the present invention, one or more light-receiving elements correspond to each of the light-emitting elements. Assume that n-number of light-receiving elements correspond to one light-emitting element, where n is equal to larger than one. That is, n-number of light-receiving elements forms the corresponding light-receiving element, and therefore N is equal to n·M. The practical value of n will be from about two to about four.

In another embodiment of the present invention, two or more light-emitting elements correspond to each of the light-receiving elements. Assume that m-number of light-emitting elements correspond to one light-receiving element, where m is equal to larger than two. That is, m-number of light-emitting elements forms the corresponding light-emitting element, and therefore M is equal to m·N. The practical value of m will be from about two to about four.

M-number of light-emitting elements forming the light-emitting unit can be turned ON/OFF in various manners. For example, all the light-emitting elements are turned ON/OFF in a continuous manner or an intermittent manner. Alternatively, the light-emitting elements are turned ON/OFF, sequentially one after another from an end. Still alternatively, the light-emitting elements are separated into several groups. The separated light-emitting elements are turned ON/OFF sequentially on the group basis from a group arranged on an end. Alternatively, the light-emitting elements are turned ON/OFF, sequentially one after another.

It is possible to perform the methods of detecting the toner pattern according to any of the embodiments by using the reflection-type optical sensor according to any of the embodiments. It is possible to perform the methods of detecting the position of the toner pattern according to any of the embodiments by using the image forming apparatus according to any of the embodiments.

If, in the spots of the detection light that are aligned in the direction perpendicular to the sub-direction, the adjacent spots are separated from each other in the main-direction, the patterns as the toner pattern can be formed to have the length in the main-direction smaller than a distance between the adjacent spots in the main-direction. The patterns can be formed to have any length as long as at least one of the patterns aligned in the main-direction as the toner pattern is exposed to the detection light emitted from the M-number of light-emitting elements without fail.

An image forming apparatus according to a first embodiment of the present invention is described with reference to FIG. 1.

The image forming apparatus illustrated in FIG. 1 is a color image forming apparatus; however, the following description will apply even to a monochrome image forming apparatus. A color image is formed with four toners including yellow (Y), magenta (M), cyan (C), and black (K).

The image forming apparatus includes an optical scanning device 20. The optical scanning device 20 can be any widely-known scanner.

The image forming apparatus includes drum-shaped photosensitive elements 11Y, 11M, 11C, and 11K as photoconductive latent-image carriers. The photosensitive element 11Y is used for forming a yellow toner image, the photosensitive element 11M is for a magenta toner image, the photosensitive element 11C is for a cyan toner image, and the photosensitive element 11K is for a black toner image.

The optical scanning device 20 writes images onto the photosensitive elements 11Y, 11M, 11C, and 11K by the optical scanning. The photosensitive elements 11Y, 11M, 11C, and 11K are rotated in a clockwise direction at a constant speed, charged evenly by charging rollers TY, TM, TC, and TK as charging units, and scanned by the optical scanning device 20. Thus, electrostatic latent images (negative latent images) for yellow, magenta, cyan, and black are written onto the photosensitive elements 11Y, 11M, 11C, and 11K, respectively.

Those electrostatic latent images are developed by developing devices GY, GM, GC, and GK, and thus the yellow toner image, the magenta toner image, the cyan toner image, and the black toner image are formed on the photosensitive elements 11Y, 11M, 11C, and 11K, respectively as positive images.

The toner images are transferred onto a recording sheet (not shown) (e.g., transfer paper and plastic sheet for overhead projector) via a transfer belt 17.

The recording sheet is conveyed from a sheet table (not shown) that is arranged under the transfer belt 17 to an upper-right circumference of the transfer belt 17 illustrated in FIG. 1. After that, the recording sheet is attached to the transfer belt 17 by the exertion of the electrostatic force, and is conveyed to the left side of FIG. 1 by counterclockwise rotation of the transfer belt 17. The recording sheet sequentially receives, while being conveyed, the yellow toner image from the photosensitive element 11Y by a transfer member 15Y, the magenta toner image from the photosensitive element 11M by a transfer member 15M, the cyan toner image from the photosensitive element 11C by a transfer member 15C, and the black toner image from the photosensitive element 11K by a transfer member 15K.

In this manner, a color image is formed on the recording sheet in a superimposed manner.

After that, the color image is fixed onto the recording sheet by a fixing device 19. The recording sheet with the color image is discharged out of the image forming apparatus. The color image can be formed onto an intermediate transfer belt in the superimposed manner and then transferred from the intermediate transfer belt to the recording sheet, instead of directly being formed on the recording sheet.

The image forming apparatus illustrated in FIG. 1 includes reflection-type optical sensors OS1 to OS4. In the image forming apparatus, the images are written onto the photosensitive elements 11Y, 11M, 11C, and 11K by the optical scanning as described above. The main-scanning direction in the optical scanning is a direction perpendicular to the drawing shown in FIG. 1 called "main-direction".

A method of detecting the position of the toner pattern by using the reflection-type optical sensors OS1 to OS4 is described below. The optical scanning device 20 writes a certain electrostatic latent image onto each of the photosensitive elements 11Y, 11M, 11C, and 11K; the developing devices GY, GM, GC, and GK develop the electrostatic latent images to the toner images; the toner images are transferred from the photosensitive elements 11Y, 11M, 11C, and 11K directly to the surface of the transfer belt 17. Thus, the four toner patterns in the different colors are formed.

It is clear from the above description that the transfer belt 17 works as "supporting member" in the first embodiment. This is why, the transfer belt 17 is called "supporting member 17", appropriately. The toner pattern is formed on the transfer belt 17, i.e., the supporting member, and is moved by the rotation of the transfer belt 17 to a detection area.

After that, the position of each toner pattern on the transfer belt 17 is detected by using the reflection-type optical sensors OS1 to OS4.

The toner pattern is removed from the surface of the transfer belt 17 by a cleaning device (not shown) arranged right, i.e., downstream of the reflection-type optical sensors OS1 to OS4.

Figure 2:
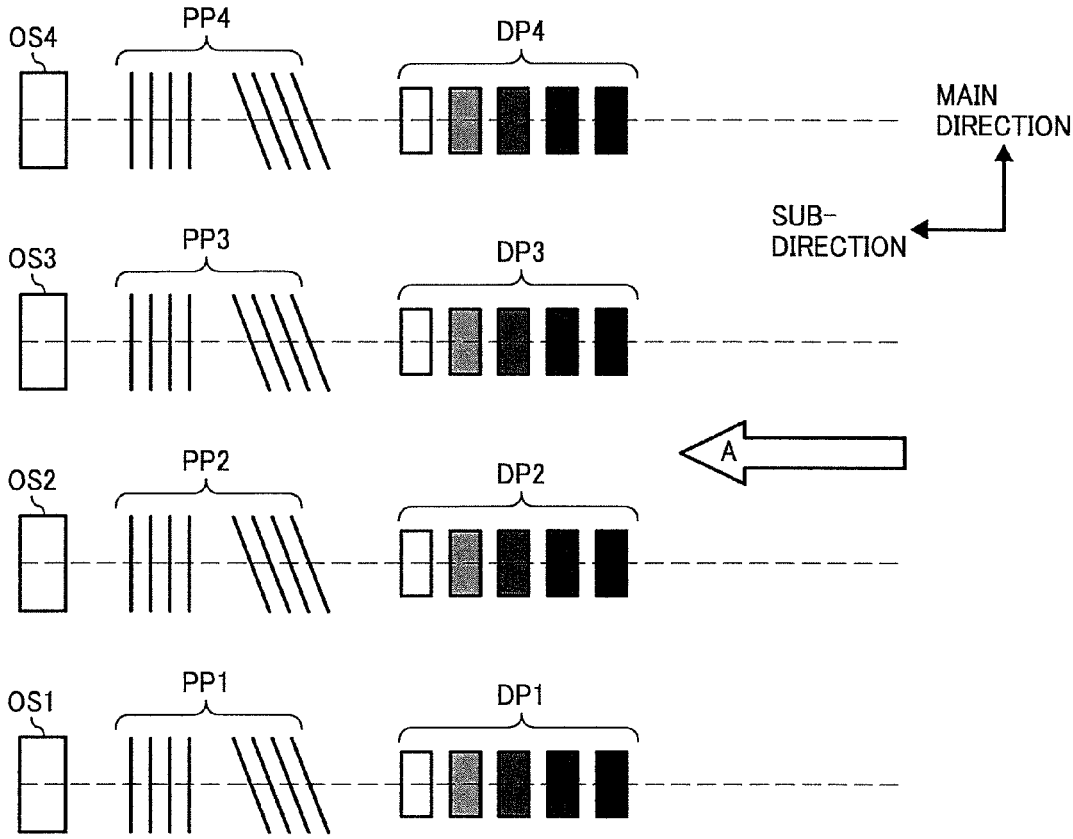
FIG. 2 is a schematic diagram for explaining toner-pattern detection performed by a reflection-type optical sensor illustrated in FIG. 1.

FIG. 2 is a schematic diagram for explaining a relation between the toner pattern that is formed on the transfer belt 17, i.e., the supporting member and the reflection-type optical sensors OS1 to OS4.

The direction in which the reflection-type optical sensors OS1 to OS4 are arranged in FIG. 2 is the main-direction. On the other hand, the direction, indicated by an arrow A in which the transfer belt 17 rotates, is the sub-direction.

Toner patterns PP1 to PP4 illustrated in FIG. 2 are used to adjust the positional relation among the yellow toner image, the magenta toner image, the cyan toner image, and the black toner image that are transferred onto the transfer belt 17. In the detection of the position of the toner pattern, the toner patterns PP1 to PP4 are detected.

The density patterns DP1 to DP4 are used to measure the toner density.

Each of the toner patterns PP1 to PP4, as illustrated in FIG. 2, includes eight similar line patterns extending in the main-direction. The eight line patterns are arranged parallel to each other with the centers thereof aligned in the sub-direction.

The density pattern DP1 is used for the measurement of the yellow toner density, the density pattern DP2 is for the magenta toner density, the density pattern DP3 is for the cyan toner density, and the density pattern DP4 is for the black toner density.

In other words, the reflection-type optical sensors OS1 to OS4 detect the positions of the various-colored toner patterns at four points aligned in the main-scanning direction, i.e., the main-direction.

Moreover, the reflection-type optical sensor OS1 measures the yellow toner density, the reflection-type optical sensor OS2 measures the magenta toner density, the reflection-type optical sensor OS3 measures the cyan toner density, and the reflection-type optical sensor OS4 measures the black toner density.

In the example illustrated in FIG. 2 the density patterns DP1 to DP4 are aligned in the main-direction; however, it is possible to align the density patterns DP1 to DP4 in the sub-direction. In the later case, the reflection-type optical sensor OS1 sequentially measures the various toner densities. It is allowable to stop operation of the reflection-type optical sensor OS4 and detect the toner patterns PP1 to PP3 at the three points aligned in the main-scanning direction by using the other three reflection-type optical sensors OS1 to OS3.

Although the reflection-type optical sensor detects the toner pattern that is formed on the transfer belt 17 that is used to convey the recording sheet and transfer the toner image onto the recording sheet in the first embodiment, the reflection-type optical sensor can be configured to detect the toner pattern that is formed on the photosensitive element as the latent-image carrier or the intermediate transfer belt (or intermediate transfer medium).

The reflection-type optical sensors OS1 to OS4 and the detection of the toner pattern are described below.

Figure 3A:
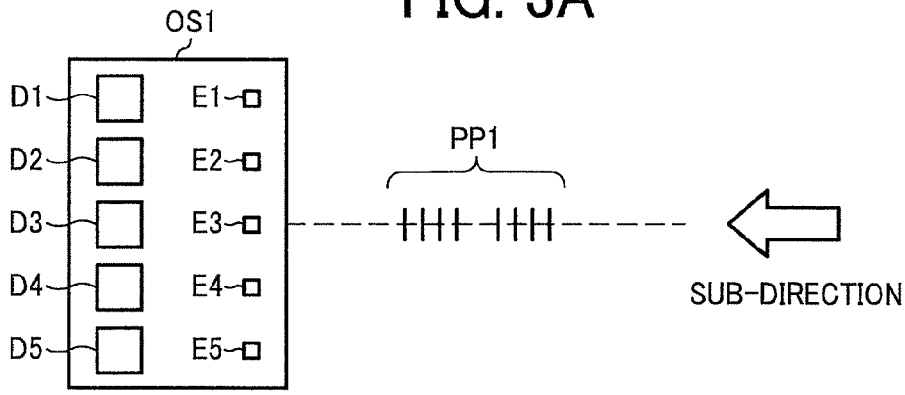
FIGS. 3A to 3E are schematic diagrams for explaining the toner-pattern detection by the reflection-type optical sensor.

The four reflection-type optical sensors OS1 to OS4 have the same structure, and therefore only the reflection-type optical sensor OS1 is described. FIG. 3A is a schematic diagram of the reflection-type optical sensor OS1.

The arrow in FIG. 3A corresponds to the sub-direction and a direction perpendicular to the sub-direction in the plane of the paper corresponds to the main-direction.

The reflection-type optical sensor OS1 includes a light-emitting unit and a light-receiving unit. The light-emitting unit and the light-receiving unit are accommodated in housing as a unit. The light-emitting unit includes M-number of light-emitting elements E1 to E5 (M=5) that emits a detection light. The light-emitting elements E1 to E5 are aligned parallel to the main-direction at an equal pitch. The light-receiving unit includes N-number of light-receiving elements D1 to D5 (N=5) that receives a reflected light. The light-receiving elements D1 to D5 are also aligned parallel to the main-scanning direction at an equal pitch. The reflection-type optical sensor OS1 is arranged at the lower position on the transfer belt 17 as illustrated in FIG. 1.

Figure 3B:
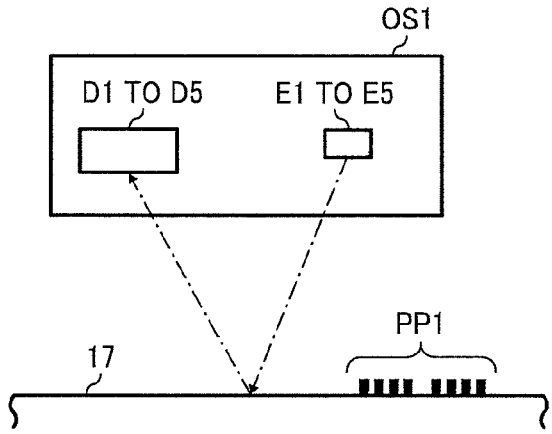

The light-emitting elements E1 to E5 are aligned in the main-direction on positions corresponding to the light-receiving elements D1 to D5, respectively. As illustrated in FIG. 3B, when the light-emitting element Ei, where i is an arbitrary integer from 1 to 5, emits the detection light to the surface of the transfer belt 17 as the supporting member, the corresponding light-receiving element Di receives the detection light reflected from the transfer belt 17. It means that the pitch between adjacent ones of the light-receiving elements D1 to D5 is equal to the pitch between adjacent ones of the light-emitting elements E1 to E5.

To make the description simpler, the surface of the transfer belt 17 is assumed to be specular. When the light-emitting element Ei, where i is an arbitrary integer from 1 to 5, emits the detection light, the corresponding light-receiving element Di receives the detection light specularly reflected from the surface of the transfer belt 17.

That is, the reflected light, illustrated in FIG. 3B that any of the light-receiving elements D1 to D5 receives, is a specular light reflected from the surface of the transfer belt 17.

The light-emitting elements E1 to E5 are, for example, LEDs. The light-receiving elements D1 to D5 are, for example, PDs.

The pitch of the light-emitting elements E1 to E5 is set to such a value that, when the light-emitting elements E1 to E5 emit the detection light and five spots of the detection light are formed on the surface of the transfer belt 17 aligned in the main-direction, a distance between adjacent ones of the spots is smaller than the length of the toner pattern PP1 in the main-direction.

Figure 3C:
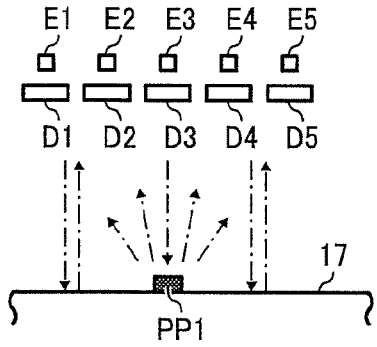
Figure 3D:
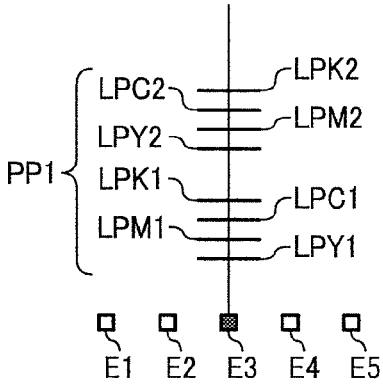

The toner pattern PP1, as illustrated in FIG. 3D, includes eight line patterns LPY1, LPM1, LPC1, LPK1, LPY2, LPM2, LPC2, and LPK2, each extending in the main-direction (i.e., the right-and-left direction in the plane of the paper shown in FIG. 3D). Those line patterns LPY1, LPM1, LPC1, LPK1, LPY2, LPM2, LPC2, and LPK2 are arranged parallel to each other, with the centers thereof aligned in the sub-direction.

A distance between a first group of the line patterns LPY1, LPM1, LPC1, and LPK1 and a second group of the line patterns LPY2, LPM2, LPC2, and LPK2 is slightly larger than a pitch between adjacent ones of the line patterns LPY1, LPM1, LPC1, and LPK1 or the line patterns LPY2, LPM2, LPC2, and LPK2.

The line patterns LPY1 and LPY2 form a pair. Both of the line patterns LPY1 and LPY2 are formed with the yellow toner. The line patterns LPM1 and LPM2 form a pair. The line patterns LPM1 and LPM2 are formed with the magenta toner. The line patterns LPC1 and LPC2 form a pair. The line patterns LPC1 and LPC2 are formed with the cyan toner. The line patterns LPK1 and LPK2 form a pair. The line patterns LPK1 and LPK2 are formed with the black toner.

The length of the line patterns in the main-direction is smaller than the width of an exposed area on the transfer belt 17 in the main-direction where exposed to the detection light emitted from the light-emitting elements E1 to E5.

As illustrated in FIGS. 3A and 3B, the toner pattern PP1 is formed on the surface of the transfer belt 17 as the supporting member, and then is moved toward the detection area of the reflection-type optical sensor OS1.

Timing when the toner pattern PP1 is formed and time required for the toner pattern PP1 to move to the detection area are substantially fixed. When the toner pattern PP1 approaches the detection area, the light-emitting elements E1 to E5 start ON/OFF.

The size of the spot, which are formed on the surface of the transfer belt 17 when the light-emitting elements E1 to E5 emit the detection light, is set to, for example, 2 mm smaller than the pitch of the light-emitting elements E1 to E5 of, for example, 3 mm. The five spots are aligned in the main-direction on the transfer belt 17.

Each of the line patterns of the toner pattern PP1 has the length in the main-direction of, for example, 2 mm smaller than the pitch of the light-emitting elements E1 to E5 of, for example, 3 mm.

That is, the distance between the adjacent spots in the main-direction is 1 mm, which is smaller than the length of the line patterns in the main-direction of 2 mm.

The light-emitting elements E1 to E5 turn ON/OFF, sequentially starting from the light-emitting element E1 to the light-emitting element E5. More particularly, the light-emitting element E1 turns ON and then OFF, firstly. The light-emitting element E2 turns ON and then OFF, secondly. After that, the light-emitting element E3 turns ON and then OFF, thirdly. Subsequently, the light-emitting element E4 and then the light-emitting element E5 turn ON/OFF, in the same manner.

The ON/OFF operation of those light-emitting elements E1 to E5 is repeated at a high speed. Thus, the surface of the transfer belt 17 is scanned in the main-direction over and over with the five spots of the detection light. This operation is called, hereinafter, "spot scanning with the detection light".

As described above, the surface of the transfer belt 17 is specular. If the detection light strikes a region where there is no toner pattern, the reflected detection light is the specular light. The light-receiving element Di, where i is an arbitrary integer from 1 to 5, is in position to receive, when the detection light is specularly reflected from the area out of the toner pattern, the specular light that has been emitted from the corresponding light-emitting element Ei only.

Consider, for example, a case where the center of the toner pattern PP1 in the main-direction falls on the spot of the detection light that is emitted from the light-emitting element E3 under the above-described conditions. As illustrated in FIG. 3C, when the light-emitting elements E1, E2, E4, and E5 emit the detection light to the transfer belt 17, the detection light is specularly reflected from the surface of the transfer belt 17, and then is received at the light-receiving elements D1, D2, D4, and D5, respectively.

On the other hand, when the light-emitting element E3 turns ON and emits the detection light to the toner pattern PP1, a part of the detection light is specularly reflected and the other part of the detection light is diffusely reflected by the toner pattern PP1.

More particularly, viewed from the outputs of the light-receiving elements D1 to D5, when the light-emitting element E3 emits the detection light, an amount of light received at the light-receiving element D3 marks a low value, while outputs of the other light-receiving elements D1, D2, D4, and D5 mark larger than zero.

It is determined from the result of the outputs that one of the line patterns the toner pattern PP1 is at a position exposed to the detection light emitted from the light-emitting element E3. Thus, the position of the toner pattern PP1 in the main-direction is detected.

If the toner pattern PP1 is between, for example, the light-emitting elements E3 and E4, when the light-emitting element E3 is ON, the output of the light-receiving element D3 marks a low value. When the light-emitting element E4 is ON, the output of the light-receiving element D4 marks a low value.

In this manner, it is determined from the result of the outputs that any of the line patterns of the toner pattern PP1 is between the light-emitting elements E3 and E4 in the main-direction.

If the output of the light-receiving element D3 is lower than the output of the light-receiving element D4, the detection light from the light-emitting element E3 is more diffusely reflected than the detection light from the light-emitting element E4 is. That is, the toner pattern PP1 is closer to the light-emitting element E3 than the light-emitting element E4. In this manner, even if the toner pattern PP1 is between the light-emitting elements E3 and E4, the position of the toner pattern PP1 in the main-direction is calculated from a ratio between the outputs.

In this manner, the position of the toner pattern PP1 in the main-direction can be detected accurately by one digit equal to or smaller than the pitch of the light-emitting elements E1 to E5.

It means that, if, for example, 100 light-emitting elements E1 to EM (M=100) are aligned at a 100-μm pitch in the main-direction, the arrangement width is 10 mm.

A total of 100 light-receiving elements D1 to DN (N=100) are aligned in the main-direction at the 100-μm pitch in the same manner as the light-emitting elements E1 to EM. When the light-emitting element Ei, where i is an arbitrary integer from 1 to 100, emits the detection light to the supporting member, the detection light is specularly reflected, and is received at the corresponding light-receiving element Di. The width of the toner pattern in the main-direction is equal to the pitch of the light-emitting elements E1 to EM of 100 μm. A change in the output of the light-receiving element Di is analyzed, while the light-emitting elements E1 to E100 turn ON/OFF sequentially. If, when a light-emitting element Ej and a light-emitting element Ej+1 turn ON, the output of a light-receiving element Dj and the output of a light-receiving element Dj+1 are low, it is determined that the toner pattern is between the light-emitting elements Ej and Ej+1 in the main-direction.

Thus, the position of the toner pattern having the length of 100 μm in the main-direction is detected accurately by one digit equal to or smaller than 100 μm from the distribution of the outputs of the light-receiving elements D1 to D100.

As described above, usage of an LED array facilitates, for example, the arrangement of 100 light-emitting elements at the 100-μm pitch. Moreover, usage of a PD array facilitates, for example, the arrangement of 100 light-receiving elements at the 100-μm pitch.

Even several tens- to several hundreds-em pitch LED and PD arrays are available.

A reflection-type optical sensor including LEDs individually working as the light-emitting elements E1 to E5 and PDs individually working as the light-receiving elements D1 to D5 can be used as the reflection-type optical sensor OS1 according to the first embodiment. The LEDs and the PDs are formed by resin molding or by surface mounting at an integrated and high-density manner. If extremely small LEDs and PDs dimensions of which can be adjusted in the millimeter are used, the pitch can be decreased to 1 mm or smaller.

The detection of the position in the sub-direction is described below.

As illustrated in FIG. 3D, in the pairs of the same-colored line patterns including the pair of line pattern LPY1 and LPY2, the pair of line pattern LPM1 and LPM2, the pair of line pattern LPC1 and LPC2, and the pair of line pattern LPK1 and LPK2, the pair line patterns are formed spaced away from each other by a fixed distance in the sub-direction (the up-and-down direction in the plane of the paper shown in FIG. 3D).

If the pair line patterns are actually formed spaced away from each other by the fixed distance as expected, the positional relation among the yellow toner image, the magenta toner image, the cyan toner image, and the black toner image is correct in the sub-direction.

To detect whether the positional relation in the sub-direction is correct, as illustrated in FIG. 3D, the light-emitting elements E1 to E5 are turned ON/OFF sequentially at proper timing when the toner pattern PP1 comes close to the reflection-type optical sensor OS1.

The timing to turn the light-emitting elements E1 to E5 ON/OFF sequentially is fixed. Therefore, if, in response to the detection light from the light-emitting element E2, the output of the light-receiving element D2 decreases, while the outputs of the other light-receiving elements D1, D3, D4, and D5 increases, it is determined that a first one out of the line patterns as the toner pattern PP1 is exposed to the detection light emitted from the light-emitting element E2 at a time point Et2 when the light-emitting element E2 is turned ON. Thus, the first line pattern is detected.

The ON/OFF operation of the light-emitting elements E1 to E5 is repeated. After the time point Et2, if, in response to the detection light from the light-emitting element E5, the output of the light-receiving element D5 decreases, while the outputs of the other light-receiving elements D1, D2, D3, and D4 increases, it is determined that a second line pattern subsequent to the first line pattern of the toner pattern PP1 is exposed to the detection light emitted from the light-emitting element E5 at a time point Et5 when the light-emitting element E5 is turned ON. Thus, the second line pattern is detected.

The distance between the first line pattern and the second line pattern, which are adjacent to each other in the sub-direction, is calculated from a difference between the time point Et5 and the time point Et2. In this case, the distance is equal to V(Et5−Et2), where V is rotating speed of the transfer belt 17.

In other words, the pitch of the line patterns in the sub-direction is calculated from a difference between a time point Etj and a time point Eti (Etj−Eti), where Eti is a time point when a line pattern is detected, and Etj is a time point when another line pattern adjacent to the previously detected line pattern is detected.

In this manner, the pitches between adjacent ones of the eight line patterns are calculated.

If the pitches between adjacent ones of the line patterns LPY1, LPM1, LPC1, and LPK1 are equal, and the pitches between adjacent ones of the line patterns LPY2, LPM2, LPC2, and LPK2 are equal, it is determined that the image forming conditions related to the optical scanning are correct, i.e., the various-colored toner images will be properly superimposed on each other in the color image formation.

Suppose, as incorrect image-forming conditions, a case where the timing to write to the photosensitive element 11M is slightly earlier than timing to write to the other photosensitive elements in the image forming apparatus illustrated in FIG. 1. In this case, the pitch between the line patterns LPY1 and LPM1 becomes smaller than the reference pitch, and the pitch between the line patterns LPM1 and LPC1 becomes larger than the reference pitch.

Moreover, the pitch between the line patterns LPY2 and LPM2 becomes smaller than the reference pitch, and the pitch between the line patterns LPM2 and LPC2 becomes larger than the reference pitch.

In this manner, it is determined whether the conditions for forming the various-colored toner images are correct from the pitches between adjacent ones of the line patterns. Moreover, a correction amount can be calculated from the pitches of adjacent ones of the line patterns. In the above-described case, the timing to write to the photosensitive element 11M is adjusted.

The reflection-type optical sensors OS1 to OS4 measure the toner density on the color basis by using the density patterns DP1 to DP4, respectively.

The density pattern DP1 is used to measure the yellow toner density. The density pattern DP1 includes five rectangular toner patterns having different gradated densities aligned in the sub-direction at the predetermined pitch.

If, for example, the spot of the detection light emitted from the light-emitting element E3 falls on the density pattern while the light-emitting elements E1 to E5 turn ON/OFF sequentially, the intensity of the specular reflection light received at the light-receiving element D3 decrease while the outputs of the other light-receiving elements increase by the amount of the diffuse reflection light.

The amount of the specular reflection light is inversely proportional to the toner density, while the amount of the diffusion reflection light is directly proportional to the toner density.

Therefore, the toner density of the density patterns can be measured from the output of the light-receiving element D3 representing the specular reflection light and the outputs of the other light-receiving elements. More particularly, those outputs are amplified by an amplifier (not shown), and then subjected to a desired signal processing. After that, the toner density is calculated from the processed signal by using a toner-density calculating process.

An algorithm for calculating the toner density is determined experimentally based on a practical embodiment of the image forming apparatus.

It has been described above that setting of a pitch of the light-emitting elements and the light-receiving elements to a smaller value makes it possible to detect the position of the toner pattern having a short length in the main-direction accurately with such a small digit equal to or smaller than the pitch of the light-emitting elements and the light-receiving elements.

Moreover, it has been described above that the toner density is measured accurately by emitting the detection light from the reflection-type optical sensor to the correct position of the density pattern.

In the first embodiment, if independent extremely small LEDs and PDs aligned at about 1-mm pitch are used as the light-emitting elements E1 to E5 and the light-receiving elements D1 to D5, the length of the toner pattern PP1 in the main-direction is enough to about 1 mm.

The toner pattern PP1 including the eight line patterns as illustrated in FIGS. 3A and 3D is formed in such a manner, for example, that the width of the individual line patterns in the sub-direction is set the same as in the conventional pattern. In this case, if the length of the conventional line pattern in the main-direction is 25 mm, the area of the toner pattern PP1 decreases to 1/25 of the area of the conventional line pattern.

Figure 3E:
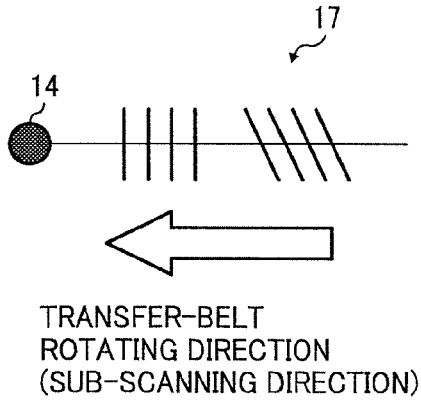

Such a small toner pattern can be formed in a time shorter than the time that it takes to form the conventional toner pattern illustrated in FIG. 3E in the sub-direction. The reference numeral 14 illustrated in FIG. 3E denotes an optical sensor. Accordingly, the small toner pattern is desirable to maintain the operating efficiency of the main activity, i.e., the image formation.

Moreover, the amount of the toner for the toner pattern is remarkably decreased to 1/25 in the same ratio as the area of the toner pattern is decreased.

As described with reference to FIGS. 3A to 3C, in the reflection-type optical sensor OS1, the light-emitting elements E1 to E5 turn ON/OFF sequentially to detect the toner patterns. It takes a certain time from the ON/OFF of the light-emitting element E1 to the ON/OFF of the light-emitting element E5. The certain time is called "scanning time".

The toner pattern (i.e., individual line patterns) should be within an area to be subjected to the spot scanning by the reflection-type optical sensor (i.e., area where the sequentially flashing spots of the detection light falls) (hereinafter, "scanning area") during the scanning time. In other words, the sequential ON/OFF of the light-emitting elements E1 to E5 are performed while the toner pattern is within the scanning area.

If M, which is the number of the light-emitting elements of the reflection-type optical sensor, is small, the scanning time will be short.

As described above, to maintain the operating efficiency of the image formation by decreasing the time to form the toner pattern and efficiently reduce the amount of the toner for the toner pattern, it is necessary to form an effective and smaller toner pattern.

To correctly exposing the smaller toner pattern to the detection light, thereby correctly detecting the position of the toner pattern, it is necessary to decrease the pitch of the light-emitting elements and the light-receiving elements by an amount that corresponds to the decrease in the length of the toner pattern in the main-direction. The length of the arrangement area of the light-emitting elements and the light-receiving elements is required to be about 10 mm in consideration for the miss-match between the toner pattern and the reflection-type optical sensor in the main-direction. As the pitch decreases, M, which is the number of the light-emitting elements, increases to a remarkably large number. As M increases, the scanning time increases.

The supporting member with the toner pattern formed thereon moves by a distance V·st in the sub-direction in the scanning time, where st is scanning time and V is velocity of the supporting member moving in the sub-direction.

If M is too large while V is unchanged, the scanning time becomes longer than time required for the toner pattern to pass through the scanning area. If so, it is difficult to measure the correct toner density.

Figure 4A:
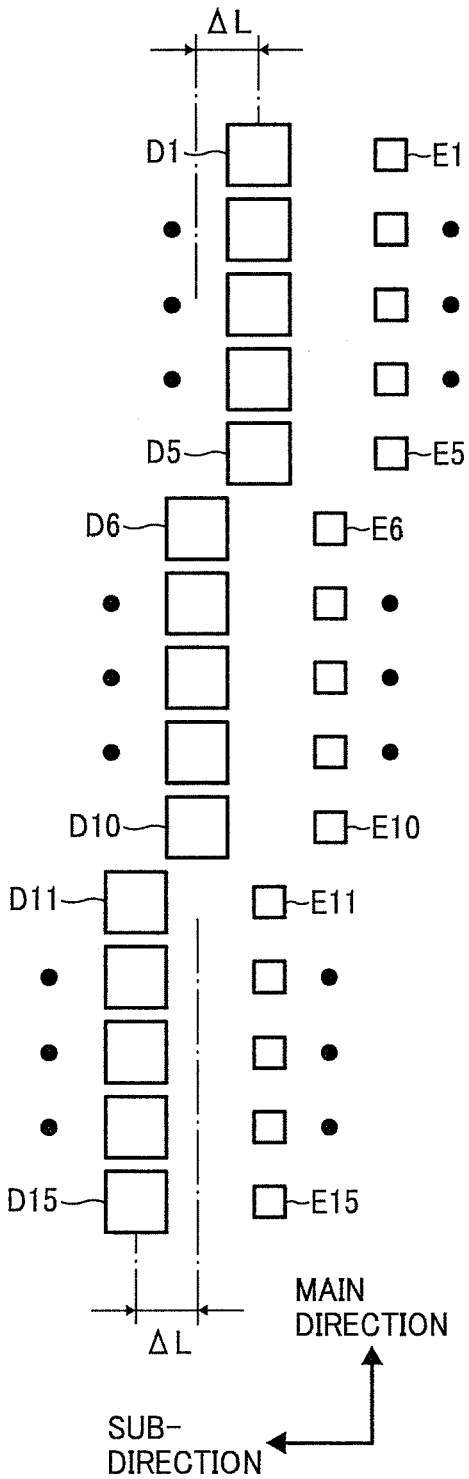
FIG. 4A is a schematic diagram of an arrangement of light-emitting elements and light-receiving in a reflection-type optical sensor according to a second embodiment of the present invention.
Figure 4B:
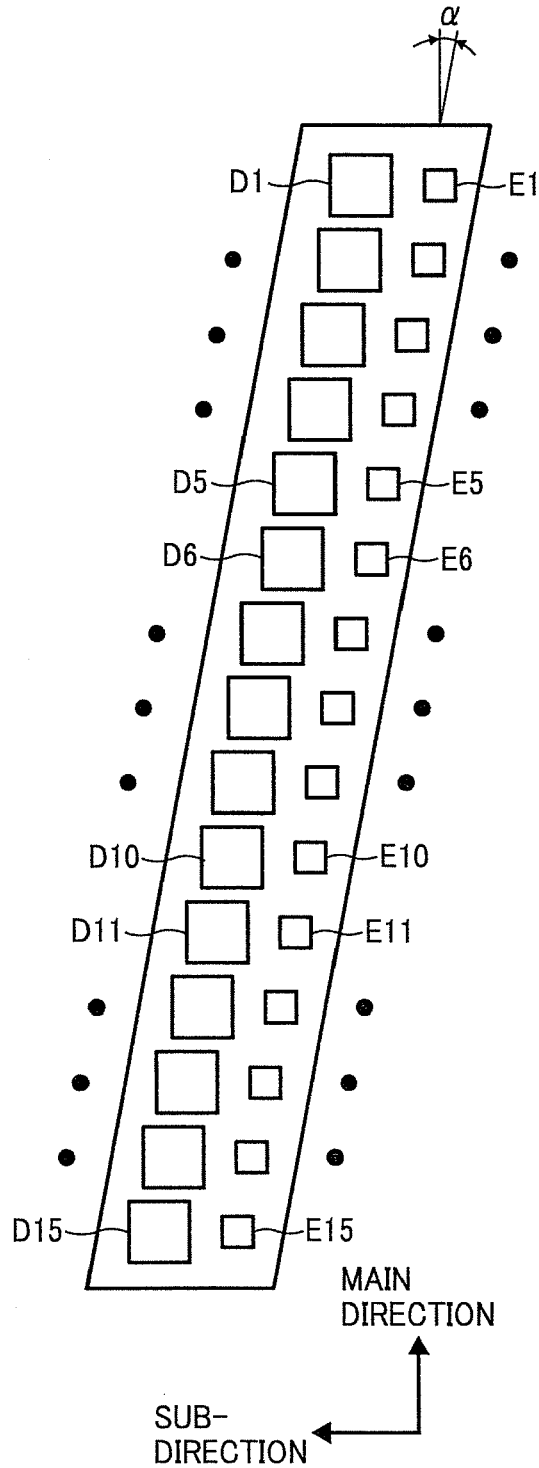
FIG. 4B is a schematic diagram of an arrangement of light-emitting elements and light-receiving in a reflection-type optical sensor according to a third embodiment of the present invention.

A second embodiment and a third embodiment of the present invention disclose a solution to this problem and those embodiments are described with reference to FIGS. 4A and 4B, respectively. Reflection-type optical sensors according to the second embodiment and the third embodiment include 15 light-emitting elements E1 to E15 and 15 light-receiving elements D1 to D15. The light-emitting elements E1 to E15 corresponds the light-receiving elements D1 to D15, respectively in the one-to-one manner. Although the light-emitting elements and the light-receiving elements illustrated in FIGS. 4A and 4B are 15, each, several tens to several hundreds of the light-emitting elements and the light-receiving elements are used in practice. To make the drawings simpler, the number of the light-emitting elements and the light-receiving elements is set to 15 in the second embodiment and the third embodiment. In other words, the light-emitting elements and the light-receiving elements can be more than 15 or less than 15.

In the second embodiment illustrated in FIG. 4A, the light-emitting elements E1 to E15 and the light-receiving elements D1 to D15 are aligned in the main-direction sequentially beginning with the light-emitting element E1 and the light-receiving element D1. Moreover, the light-emitting elements E1 to E15 and the light-receiving elements D1 to D15 that are divided into a first group, a second group, and a third group. The first group includes the light-emitting elements E1 to E5 and the light-receiving elements D1 to D5; the second group includes the light-emitting elements E6 to E10 and the light-receiving elements D6 to D10; and the third group includes the light-emitting elements E11 to E15 and the light-receiving elements D11 to D15. The light-emitting elements of each group are aligned in a single line, and the light-receiving elements of each group are aligned in a single line. When the reflection-type optical sensor is in position to measure the toner density, the line of the second group is shifted by ΔL from the line of the first group in the sub-direction, and the line of the third group is shifted by ΔL from the line of the second. The distance ΔL is decided based on the velocity of the supporting member moving in the sub-direction.

The light-emitting elements E1 to E15 turn ON/OFF sequentially while the toner pattern is moving in the sub-direction at the velocity of V.

Time required for ON/OFF of the light-emitting elements E1 to E5, time required for ON/OFF of the light-emitting elements E6 to E10, and time required for ON/OFF of the light-emitting elements E11 to E15 are equal, more particularly, st/3, where st is scanning time.

The toner pattern moves by distance V·st/3 in the sub-direction in time st/3. Therefore, if ΔL is set as follows:

$$\Delta L = V \cdot st/3$$

then the spot scanning of the toner pattern by the light-emitting elements E1 to E15 is completed within the scanning time.

In the third embodiment illustrated in FIG. 4B, when the reflection-type optical sensor is in position to measure the toner density, the light-emitting elements E1 to E15 and the light-receiving elements D1 to D15 are aligned in a single direction that is inclined to the main-direction at an angle α. The angle α is decided based on the velocity of the supporting member moving in the sub-direction.

More particularly, if the angle α satisfies a following Equation:

$$Z \cdot \tan \alpha = V \cdot st$$

where st is scanning time, Z is the length in the main-direction of lines on which the light-emitting elements E1 to E15 and the light-receiving elements D1 to D15 are aligned, then the spot scanning of the toner pattern by the light-emitting elements E1 to E15 is completed within the scanning time.

Figure 5:
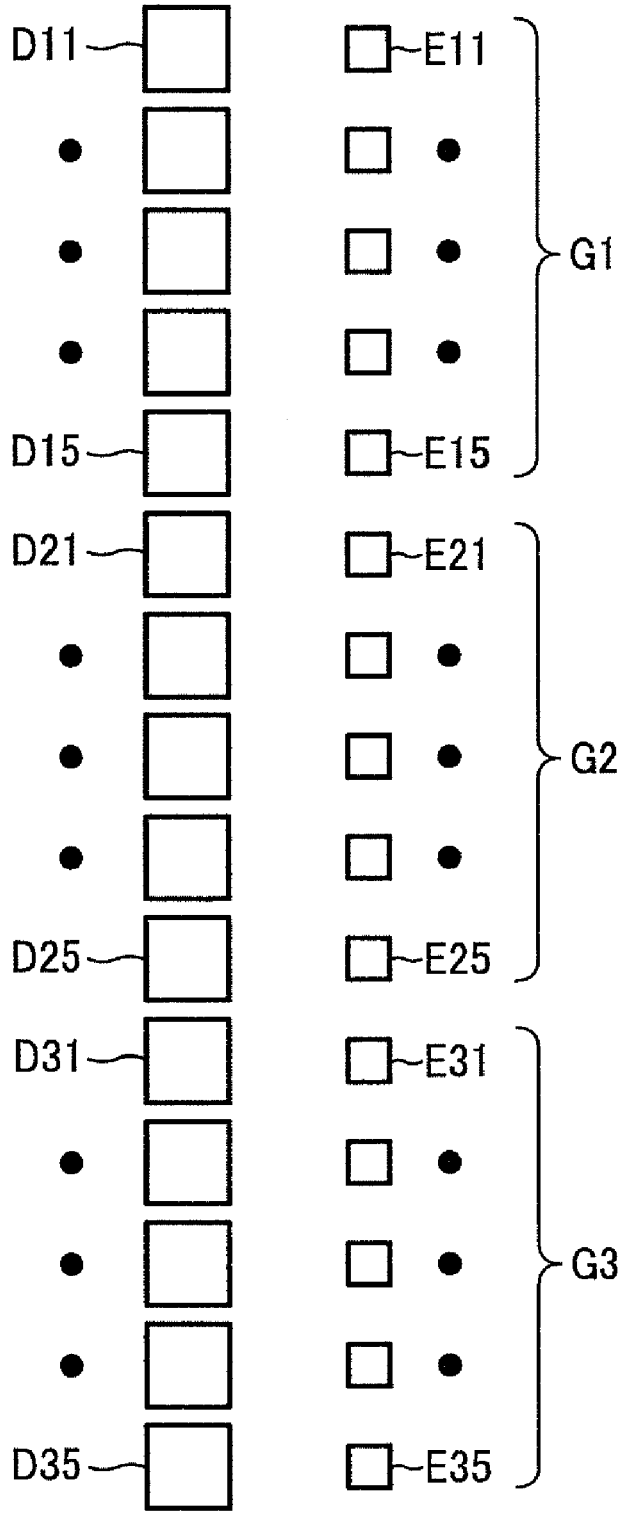
FIG. 5 is a schematic diagram of an arrangement of light-emitting elements and light-receiving in a reflection-type optical sensor according to a fourth embodiment of the present invention.

In a fourth embodiment of the present invention as illustrated in FIG. 5, the spot scanning is optimized as follows.

A reflection-type optical sensor according to the fourth embodiment includes 15 light-emitting elements and 15 light-receiving elements. The light-emitting elements correspond to the light-receiving elements, respectively in the one-to-one manner. Although the light-emitting elements and the light-receiving elements illustrated in FIG. 5 are 15, each, several tens to several hundreds of the light-emitting elements and the light-receiving elements are used in practice. To make the drawings simpler, the number of the light-emitting elements and the light-receiving elements is set to 15 in the fourth embodiment. In other words, the light-emitting elements and the light-receiving elements can be more than 15 or less than 15.

When the reflection-type optical sensor is in position to measure the toner density, the direction in which the 15 light-emitting elements are aligned and the direction in which the 15 light-receiving elements are aligned are substantially parallel to the main-direction.

Each of the 15 light-emitting elements makes a pair with a corresponding one of the 15 light-receiving elements. The light-emitting elements and the light-receiving elements are divided into three groups G1, G2, and G3. The groups G1, G2, and G3 are aligned in a single line extending in the main-direction.

The group G1 includes five pairs, more particularly, the light-emitting elements E11 to E15 and the light-receiving elements D11 to D15. The group G2 includes five pairs, more particularly, the light-emitting elements E21 to E25 and the light-receiving elements D21 to D25. The group G3 includes five pairs, more particularly, the light-emitting elements E31 to E35 and the light-receiving elements D31 to D35.

All the three groups G1, G2, and G3 have the same structure.

When the reflection-type optical sensor is in position to detect the position of the toner pattern, the first light-emitting element of each group, i.e., the light-emitting elements E11, E21, and E31 turn ON/OFF simultaneously. Then, the second light-emitting element of each group, i.e., the light-emitting elements E12, E22, and E32 turn ON/OFF simultaneously. After that, the light-emitting elements E13, E23, and E33, the light-emitting elements E14, E24, and E34, and the light-emitting elements E15, E25, and E35 turn ON/OFF sequentially.

With this configuration, the scanning time can be decreased to one-third of the scanning time in the second embodiment and the third embodiment. Therefore, the spot scanning is completed while the toner pattern is passing through the scanning area.

As a variation of the fourth embodiment, it is allowable to shift the light-emitting elements and the light-receiving elements other than the light-emitting elements E11, E21, and E31 and the light-receiving elements D11, D21, and D31 in the sub-direction with the light-emitting elements E11, E21, E31 and the light-receiving elements D11, D21, D31 maintained at their respective positions illustrated in FIG. 5 in such a manner that the light-emitting elements and the light-receiving elements are aligned in a direction that is inclined to the main-direction at a certain angle. The certain angle is decided based on the velocity of the supporting member moving in the sub-direction, in the same manner as in the third embodiment.

More light-emitting elements and light-receiving elements are used in the second, the third, and the fourth embodiments as compared to the first embodiment. If the pitch is unchanged, the length of the reflection-type optical sensor in the main-direction, i.e., the sensing area increases. In other words, an allowable extent of the positional miss-match in the main-direction between the toner pattern and the reflection-type optical sensor increases. On the other hand, if the length of the reflection-type optical sensor is unchanged, the pitch between adjacent light-emitting elements and light-receiving elements decreases. This results in an increase in the spatial resolution in the main-direction.

As described above, M, which is the number of the light-emitting elements, can be set unequal to N, which is the number of the light-receiving elements. In fifth to seventh embodiments of the present invention illustrated in FIGS. 6A to 6C, respectively, M is not equal to N.

Figure 6A:
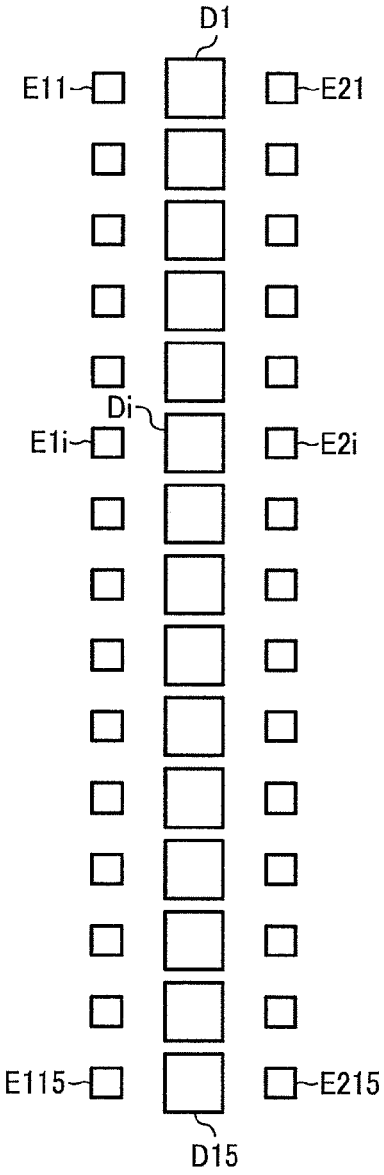
FIG. 6A is a schematic diagram of an arrangement of light-emitting elements and light-receiving in a reflection-type optical sensor according to a fifth embodiment of the present invention.

In the fifth embodiment illustrated in FIG. 6A, N is 15 and M is 30.

The light-emitting unit includes 15 light-emitting elements E11, . . . , E1*i* . . . , and E115 that are aligned in a single line extending in the main-direction at an equal pitch, and 15 light-emitting elements E21, . . . , E2*i* . . . , and E215 that are aligned in another single line extending in the main-direction at an equal pitch. Positions of the light-emitting elements E21, . . . , E2*i* . . . , and E215 in the main-direction are the same as positions of the light-emitting elements E11, . . . , E1*i*. . . , and E115, respectively.

In the fifth embodiment, the two light-emitting elements E1*i* and E2*i*, where i is an arbitrary integer from 1 to 15, correspond to the light-receiving element Di. In other words, the two light-emitting elements E1*i* and E2*i* work together as the single corresponding light-emitting element. The corresponding light-emitting elements are aligned at the pitch EPT. The pitch EPT is equal to the pitch DPT, which is the pitch of the light-receiving elements D1 to D15 aligned in the main-direction (the up-and-down direction in the plane of the paper shown in FIG. 6A).

The light-receiving unit includes 15 light-receiving elements D1, . . . , Di . . . , and D15 that are aligned in a line extending in the main-direction at the equal pitch (i.e., the pitch DPT) between the two lines of the light-emitting elements. Positions of the light-receiving elements D1, . . . , Di . . . , and D15 are the same in the main-direction as the positions of the light-emitting elements E11, . . . , E1*i*. . . , and E115, respectively, i.e., the same in the main-direction as the positions of the light-emitting elements E21, . . . , E2*i* . . . , and E215, respectively.

The light-emitting elements E11 and E21, which are aligned in the same position in the main-direction, turn ON/OFF simultaneously. After that, the light-emitting elements E12 and E22 turn ON/OFF, simultaneously. The ON/OFF operation is repeated in the same manner until the light-emitting elements E115 and E215 turn ON/OFF. Thus, the output of the detection light that illuminates the supporting member and the toner pattern becomes about double.

The output of the LEDs, which are used as the light-emitting elements, in general, depends on not the light-emitting-element area but the applied current density.

If the applied current density increases, the output increases but the lifetime of the LEDs decreases. To maintain the lifetime, the applied current density is preferably lower than a certain level. If the light-emitting-element area increases (with the applied current density unchanged), the applied current amount increases. However, an increase in the light-emitting-element area results in an increase of spots for illuminating the supporting member and the toner pattern.

To solve this problem, it is preferable to double the output of the light. This has been achieved by arranging the two lines of light-emitting units, as illustrated in FIG. 6A, with both the light-emitting-element area and the current density unchanged.

Figure 6B:
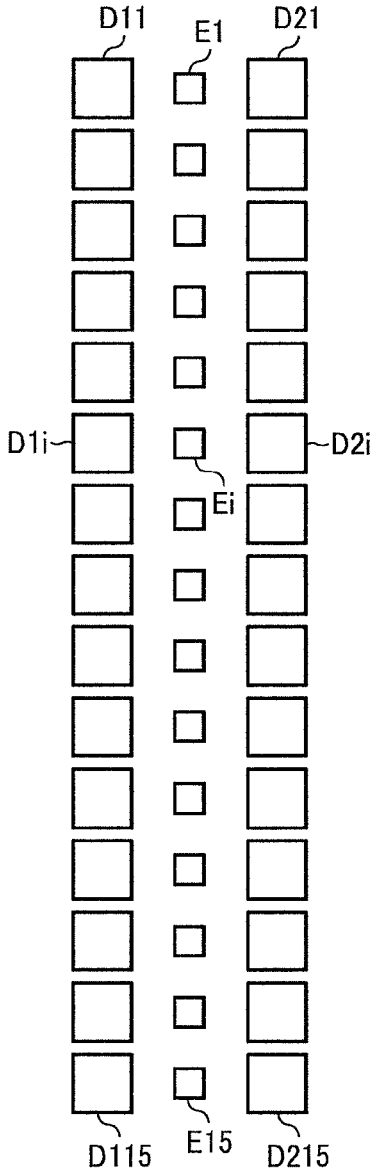
FIG. 6B is a schematic diagram of an arrangement of light-emitting elements and light-receiving in a reflection-type optical sensor according to a sixth embodiment of the present invention.

In the sixth embodiment illustrated in FIG. 6B, N is 30 and M is 15.

The light-receiving unit includes 15 light-receiving elements D11, . . . , D1*i* . . . , and D115 that are aligned in a single line extending in the main-direction at an equal pitch, and 15 light-receiving elements D21, . . . , D2*i* . . . , and D215 that are aligned in another single line extending in the main-direction at an equal pitch. The light-emitting unit includes 15 light-emitting elements E1, . . . , Ei . . . , and E15 that are aligned in a single line extending in the main-direction at an equal pitch between the two lines of the light-receiving elements. Positions of the light-emitting element Ei, the light-receiving element D1*i*, and the light-receiving element D2*i*, where i is an arbitrary integer from 1 to 15, are the same in the main-direction.

In the sixth embodiment, the two light-receiving elements D1*i* and D2*i*, where i is an arbitrary integer from 1 to 15, correspond to the light-emitting element Ei. In other words, the two light-receiving elements D1*i* and D2*i* work together as the single corresponding light-receiving element. The corresponding light-receiving elements are aligned at the pitch DPT. The pitch DPT is equal to the pitch EPT, which is the pitch of the light-emitting elements E1 to E15 in the main-direction (the up-and-down direction in the plane of the paper shown in FIG. 6B).

Because PDs, which receive the detection light (reflected light), are aligned in the two lines, the light-receiving sensitivity becomes double.

Alternatively, if the light-receiving-element area in the sub-direction is increased to double with the PDs being aligned in a single line, the light-receiving sensitivity increases. However, the increase in the light-receiving sensitivity is relatively small, especially when the size of the spot of the detection light reflected from the supporting member and the toner pattern is small. From the viewpoint of the improvement of the light-receiving sensitivity, it is more effective to arrange the PDs in the two lines symmetrically in the sub-direction and the LEDs between the two lines, as illustrated in FIG. 6B.

In the first to the sixth embodiments as described with reference to FIGS. 2 to 6B, the light-emitting elements and the light-receiving elements are aligned at the equal pitches, and the pitch of the light-emitting elements is equal to the pitch of the light-receiving elements. However, it is possible to set the pitch of the light-emitting elements different from the pitch of the light-receiving elements.

A seventh embodiment according to the present invention in which the pitch of the light-emitting elements different from the pitch of the light-receiving elements is described with reference to FIG. 6C. In the seventh embodiment, there are seven light-emitting elements E1, . . . , Ei, . . . , and E7 and 14 light-receiving elements D1, . . . , Di, . . . , and D14. The light-receiving elements are aligned at a pitch half of the pitch of the light-emitting elements. Each of the light-emitting elements E1 to E7 corresponds to two light-receiving elements. In this manner, the spatial resolution in the main-direction in increased by decreasing the pitch of the PDs.

In the seventh embodiment, the two light-receiving elements D1*i* and D1*i*+1, where i is an arbitrary integer from among 1, 3, 5, 7, 9, 11, and 13, correspond to the light-emitting element Ei, where i is an arbitrary integer from 1 to 7. In other words, the two light-receiving elements D1*i* and D1*i*+1 work together as the single corresponding light-receiving element. The corresponding light-receiving elements are aligned at the pitch DPT. The pitch DPT is equal to the pitch EPT, which is the pitch of the light-emitting elements E1 to E7 in the main-direction (the up-and-down direction in the plane of the paper shown in FIG. 6).

If the reflection-type optical sensor is arranged in a line inclined to the main-direction at the certain direction, the higher spatial resolution in the main-direction is obtained.

Assume, more particularly, that the reflection-type optical sensor is arranged in such a manner that an angle between the main-direction and the lines on which the light-emitting elements and the light-receiving elements are aligned is β, and the pitch of the light-emitting elements and the light-receiving elements is pt. Then, the pitch of points in the main-direction projected from the light-emitting elements and the light-receiving elements is decreased to pt·cos β, i.e., the spatial resolution increases.

In the above-described embodiments, the LEDs and the PDs are formed as the light-emitting elements and the light-receiving elements by the resin molding or by the surface mounting at an integrated and high-density manner. As described above, if extremely small LEDs and PDs dimensions of which can be adjusted in the millimeter are used, the pitch can be decreased to about 1 mm.

To increase the spatial resolution, it is necessary basically to decrease the pitch of the light-emitting elements and the light-receiving elements. In an LED array and a PD array in which LEDs and PDs are integrally arranged, the pitch is extremely small. The LED array and the PD array are used in an eighth embodiment and a ninth embodiment of the present invention.

Figure 7A:
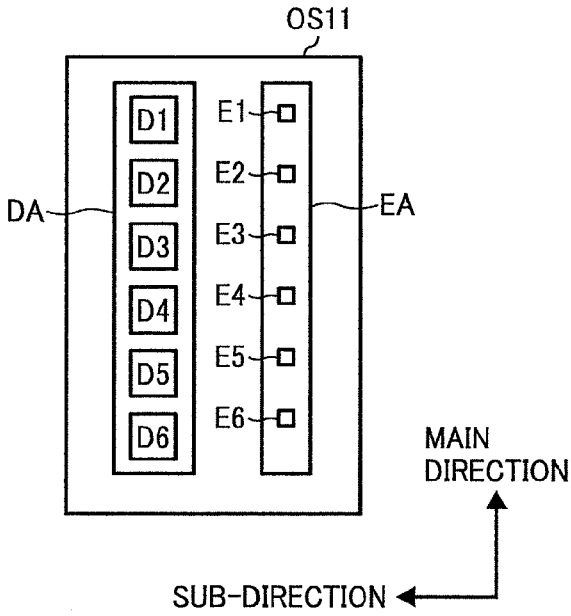
FIG. 7A is a schematic diagram of a reflection-type optical sensor according to an eighth embodiment of the present invention.

In the eighth embodiment illustrate in FIG. 7A, a reflection-type optical sensor OS11 includes an LED array (light-emitting unit) EA and a PD array (light-receiving unit) DA. The LED array EA includes six LEDs as the light-emitting elements E1 to E6 integrally aligned in a single line at an equal pitch on the same substrate. The PD array DA includes six PDs as the light-receiving elements D1 to D6 integrally aligned in a single line at an equal pitch on the same substrate. The LED array EA and the PD array DA are accommodated in the same housing of the reflection-type optical sensor OS11.

Figure 7B:
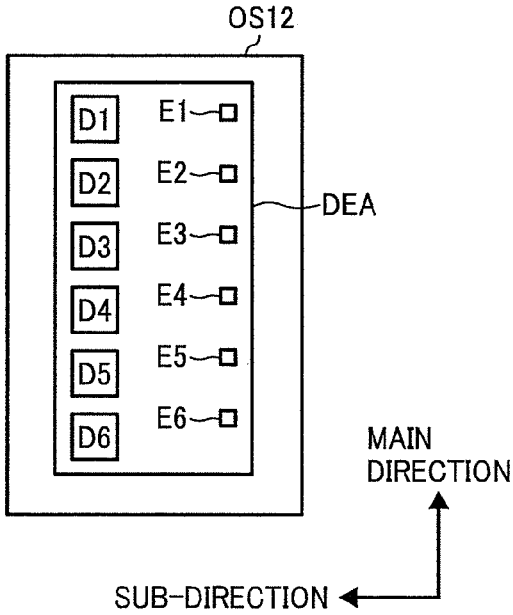
FIG. 7B is a schematic diagram of a reflection-type optical sensor according to a ninth embodiment of the present invention.

In the ninth embodiment illustrate in FIG. 7B, a reflection-type optical sensor OS12 includes a light-emitting/receiving unit array DEA. The light-emitting/receiving unit array DEA includes six LEDs as the light-emitting units E1 to E6 and six PDs as the light-receiving elements D1 to D6 arranged on the same substrate. The six LEDs are aligned in a single line at an equal pitch. The six PDs are aligned in a single line at an equal pitch. The light-emitting/receiving unit array DEA is accommodated in the same housing of the reflection-type optical sensor OS12.

As illustrated in FIGS. 7A and 7B, the pitch of the light-emitting elements is equal to the pitch of the light-receiving elements. A position of each light-emitting element in the main-direction is the same as a position of the corresponding light-receiving element. However, in the same manners as in the fifth to the seventh embodiments illustrated in the FIGS. 6A to 6C, the number of and the pitch of the light-emitting elements can be different from the number of and the pitch of the light-receiving elements.

To make the drawings and the description simpler, only six light-emitting elements and six light-receiving elements are illustrated in FIGS. 7A and 7B. In other words, the light-emitting elements and the light-receiving elements can be more than six or less than six.

In this manner, if the LED array and the PD array are used as the light-emitting unit and the light-receiving unit, the pitch of the light-emitting elements and the light-receiving elements can be from several tens of micrometers to several hundreds of micrometers. In other words, an extremely high spatial resolution can be obtained.

If the LED array and the PD array that are fabricated by the semiconductor processing are used instead of individual LEDs and PDs, it is possible to obtain a remarkably high positional accuracy in the light-emitting elements and the light-receiving elements.

In the ninth embodiment illustrated in FIG. 7B, because the LED array and the PD array are integrally formed on the same substrate, a relative positioning between the light-emitting elements and the light-receiving elements can be done extremely accurately.

As for the reflection properties of the toner patterns, the toner pattern in each color has different dependency to the wavelength. However, the toner pattern in each color has almost the same dependency to the near-infrared or infrared rays, especially, to rays having a wavelength within a rage from 800 nm to 1000 nm.

Therefore, the light-emitting elements in the reflection-type optical sensor preferably emit a light having a wavelength within the above range. Moreover, the LEDs forming the light-emitting unit preferably emit the lights having the same wavelength.

From the viewpoint of the wavelength, usage of the LED array as the light-emitting unit is preferable because the LEDs emit the lights having the same wavelength on the processing basis.

If the wavelength sensitivities of N-number of the light-receiving elements forming the light-receiving unit are different from each other, even if the light-receiving elements receive the same light reflected from the toner pattern, the outputs of the light-receiving elements differs from each other, which may cause an error in the calculation for the toner density.

Therefore, it is preferable to use PDs having the same peak sensitivity wavelength as the light-receiving elements of the light-receiving unit. From the viewpoint of the peak sensitivity wavelength, usage of the PD array as the light-receiving unit is preferable because the PDs of the PD array have the same peak sensitivity wavelength on the processing basis.

From the viewpoint of efficiency in receiving the detection light emitted from the light-emitting unit by the light-receiving unit, it is preferable to substantially match the wavelength of the detection light emitted from the LEDs forming as the light-emitting unit with the peak sensitivity wavelength of the PDs forming the light-receiving unit in an accurate manner by several tens of nanometers.

A wavelength of a light emitted from a typical GaAs-based LED is about 950 nm. A peak sensitivity wavelength of a typical Si-based PD is from 800 nm to 1000 nm. Therefore, the typical GaAs-based LEDs and the typical Si-based PDs are preferable as the light-emitting elements and the light-receiving elements.

It is possible to shift the wavelength band by adjusting the compositions or the structure of the LEDs and the PDs. Thus, the wavelength of the detection light emitted from the LEDs can be set substantially matched with the peak sensitivity wavelength of the PDs.

As described above, in the reflection-type optical sensor, the light-emitting elements of the light-emitting unit emit the spots of the detection light onto the supporting member or the toner pattern.

If individual LEDs each integrally including a member having the lens function of collecting divergent light are used as the light-emitting elements, the LEDs form the spots of the detection light all alone.

If an LED array that does not have the lens function of collecting the detection light is used as the light-emitting unit, it is necessary to add an illumination optical system that receives the detection light from the light-emitting elements and collects and guides the detection light to the surface of the supporting member and/or a light-receiving optical system that receives the light reflected from the surface of the supporting member and collects and guides the reflected light to the light-receiving elements. By the usage of the illumination optical system and/or the light-receiving optical system, the spots of the detection light can be formed.

Even if individual LEDs having the lens function of collecting the detection light are used as the light-emitting elements, it is allowable to add the illumination optical system and/or the light-receiving optical system to form the spots of the detection light in a more efficient manner.

A tenth embodiment of the present invention is described with reference to FIGS. 8A to 8C.

Figure 8A:
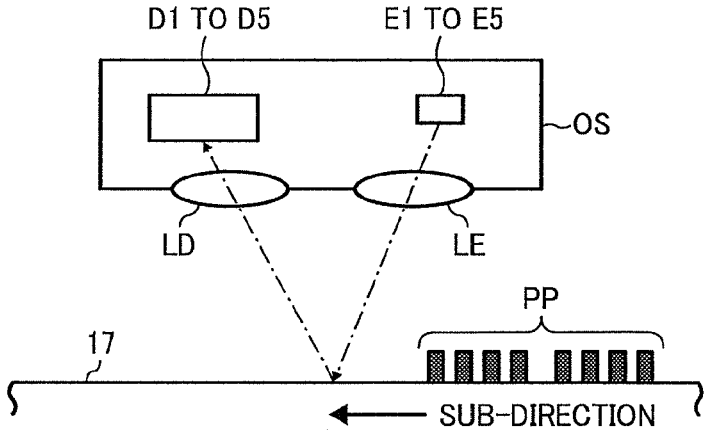
FIGS. 8A to 8C are schematic diagrams of a reflection-type optical sensor according to a tenth embodiment of the present invention

FIG. 8A is a schematic diagram of a reflection-type optical sensor OS according to the tenth embodiment, viewed in the main-direction.

The light-emitting unit includes five individual LEDs, as the light-emitting elements E1 to E5, aligned in a single line extending in the main-direction (the direction perpendicular to the plane of the paper shown in FIG. 8A) at an equal pitch. The light-receiving unit includes five individual PDs, as the light-receiving elements D1 to D5, aligned in a single line extending in the main-direction at an equal pitch. The LEDs as the light-emitting elements have the lens function of collecting the divergent light.

The reflection-type optical sensor OS includes an illumination optical system LE and a light-receiving optical system LD. The illumination optical system LE and the light-receiving optical system LD can be, as illustrated in FIGS. 8A to 8C, cylindrical lenses. The cylindrical lenses have a positive power in the sub-direction. The supporting member 17 is, more particularly, the transfer belt. The toner pattern PP is the toner image dedicated to the position detection.

The process of detecting the position of the toner pattern is performed in the same manner as described above with reference to FIGS. 2 and 3.

When the light-emitting element (LED) Ei, where i is an arbitrary integer from 1 to 5, turns ON/OFF, the detection light is collected in the sub-direction by the illumination optical system LE, and the collected detection light illuminates the supporting member 17 or the toner pattern DP. The reflected light is collected in the sub-direction by the light-receiving optical system LD, and the collected reflected light is received by the light-receiving element Di.

The illumination optical system can be used to shape the detection light so that the spot having a desired shape is formed on the supporting member or the toner pattern. The light-receiving optical system can be used to shape the reflected light so that the spot having a desired shape is formed on the light-receiving elements.

If the illumination optical system and the light-receiving optical system have the same structure, the costs for those optical systems can be suppressed. To make the drawings and the description simpler, only five light-emitting elements and five light-receiving elements are illustrated in FIGS. 8A to 8C. In other words, the light-emitting elements and the light-receiving elements can be more than five or less than five.

Figure 9A:
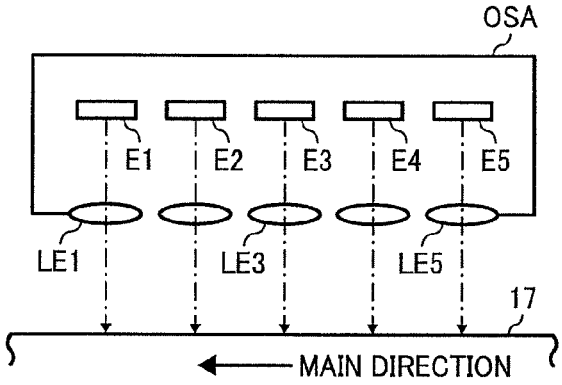
FIGS. 9A and 9B are schematic diagrams of a reflection-type optical sensor according to an eleventh embodiment of the present invention.
Figure 9B:
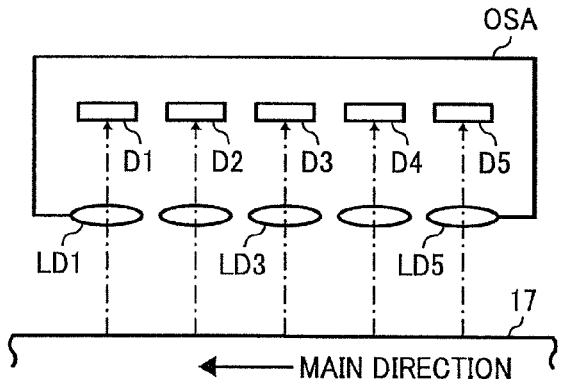

A reflection-type optical sensor OSA according to an eleventh embodiment of the present invention is described with reference to FIGS. 9A and 9B. The reflective optical element OSA includes the illumination optical system and the light-receiving optical system. As illustrated in FIG. 9A, the illumination optical system includes light-collecting lenses LE1 to LE5 in positions to receive the detection light from five LEDs as the light-emitting elements E1 to E5, respectively. The light-collecting lenses LEi, where i is an arbitrary integer from 1 to 5, receives the detection light as divergent light from the corresponding light-emitting element Ei, and collects the detection light. Thus, the efficiency in illumination to the supporting member 17 increases.

Figure 8B:
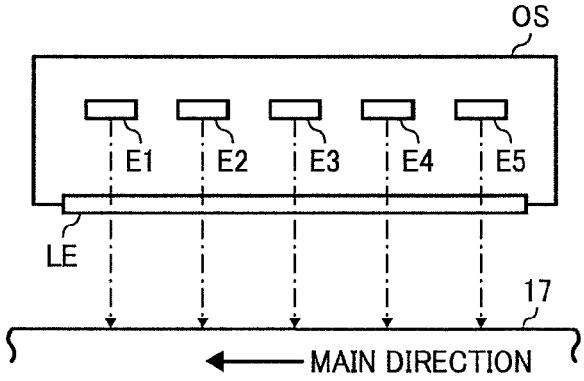
Figure 8C:
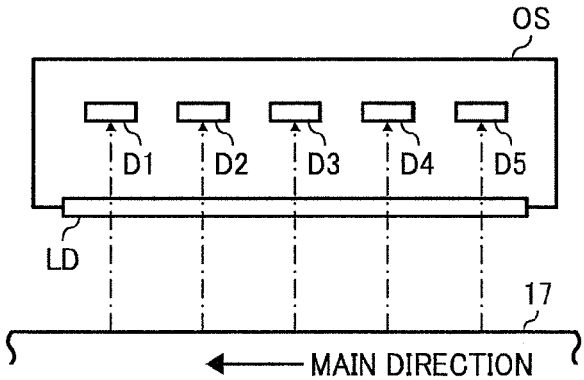

As compared to the cylindrical lens that is used as the illumination optical system illustrated in FIGS. 8A to 8C, if lenses having the collecting power in the main-direction are used, the efficiency in the illumination increases more.

Anamorphic lenses having a power in the main-direction different from a power in the sub-direction can be used as the light-collecting lens LEi, where i is an arbitrary integer from 1 to 5.

It is allowable to use the illumination optical system, which is illustrated in FIG. 9A, formed with the anamorphic lens LEi corresponding to the light-emitting element Ei in the one-to-one manner, and the light-receiving optical system, which is illustrated in FIG. 8C, formed with the cylindrical lenses having only a power in the sub-direction. A user can select a combination of a type of the illumination optical system and a type of the light-receiving optical system as appropriately, taking into consideration desired illumination efficiency, a shape of the spots of the detection light, desired light-receiving efficiency, and a shape of the spots on the light-receiving elements. To make the drawings and the description simpler, only five light-emitting elements and five light-receiving elements are illustrated in FIGS. 9A and 9B. In other words, the light-emitting elements and the light-receiving elements can be more than five or less than five.

A twelfth embodiment and a thirteenth embodiment of the present invention are described with reference to FIGS. 10A and 10B.

Figure 10A:
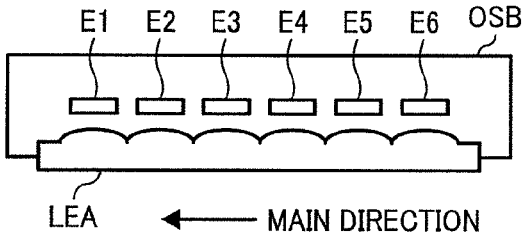
FIG. 10A is a schematic diagram of a reflection-type optical sensor according to a twelfth embodiment of the present invention.

In the twelfth embodiment illustrated in FIG. 10A, a reflection-type optical sensor OSB includes the light-emitting unit and an illumination optical system LEA. The light-emitting unit includes six LEDs as the light-emitting elements E1 to E6. The illumination optical system LEA includes convex lenses integrally arranged on a surface. The convex lenses are in positions to receive the detection light from the light-emitting elements E1 to E6, respectively and collect the received detection light.

As illustrated in FIG. 10A, although the surface facing the LEDs can collect the light, the opposite surface is flat, i.e., cannot collect the light. However, it is allowable to use surfaces that can collect the light on the both sides. Because the illumination optical system LEA is integrally formed, as compared to attaching individual lenses corresponding to the light-emitting elements, the illumination optical system LEA is easy to attach and has an advantage in the arrangement accuracy among the lens surfaces.

Although not illustrated in FIG. 10A, it is possible to use a collection of integrally-formed light-receiving lenses as the light-receiving optical system in the same manner as the light-emitting optical system.

Figure 10B:
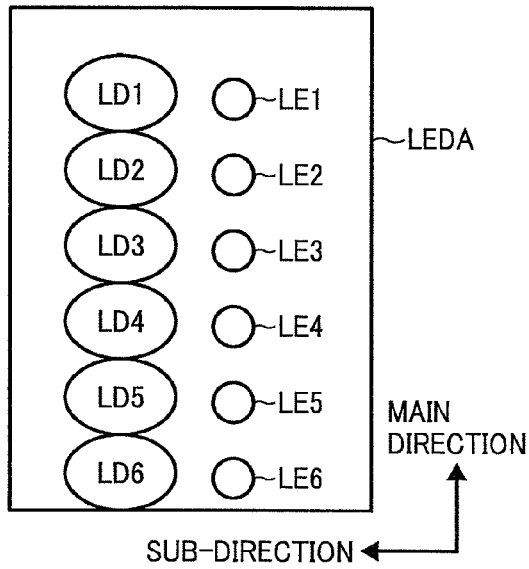
FIG. 10B is a schematic diagram of a reflection-type optical sensor according to a thirteenth embodiment of the present invention.

In the thirteenth embodiment illustrated in FIG. 10B, an illumination/light-receiving optical system LEDA includes six light-collecting lenses LE1 to LE6 as the illumination optical system and six light-collecting lenses LD1 to LD6 as the light-receiving optical system as a unit. Relative positions among those components are fixed, as appropriately.

Usage of the illumination/light-receiving optical system LEDA makes it possible to increase the accuracy in arrangement of the light-collecting lenses for the illumination optical system and the light-collecting lenses for the light-receiving optical system.

Those light-collecting lenses can be formed on a substrate made of, for example, glass or resin at the positions as illustrated in FIG. 10B by the photolithography or the nanoimprint technology.

To make the drawings and the description simpler, six light-emitting elements and six light-receiving are elements illustrated in FIGS. 10A and 10B. In other words, the light-emitting elements and the light-receiving elements can be more than six or less than six.

If, for example, the light-emitting elements and the light-receiving elements are aligned as illustrated in FIG. 4A, 4B, 6A, 6B, or 6C, the arrangements of the illumination optical system and the light-receiving optical system are changed as appropriately based on the arrangements of the light-emitting elements and the light-receiving elements.

If the illumination optical system and the light-receiving optical system are lens arrays or lens-surface arrays, the pitch of the lenses or the lens surfaces is preferably set equal.

FIGS. 11A to 12B are schematic diagrams for explaining a method of detecting the position of the toner pattern according to a fourteenth embodiment of the present invention.

Figure 11A:
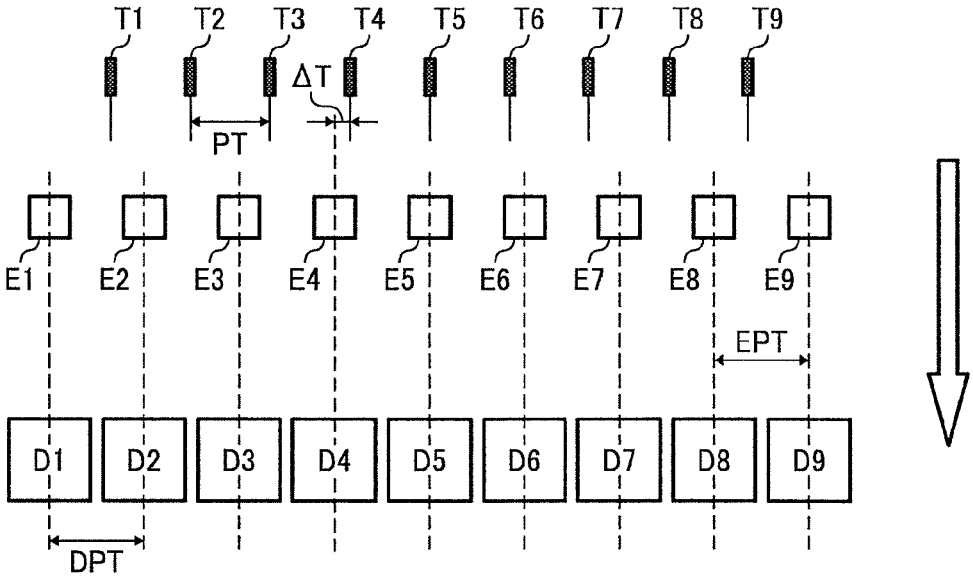
FIGS. 11A to 12B are schematic diagrams for explaining a method of detecting a position of a toner pattern according to a fourteenth embodiment of the present invention.

As illustrated in FIG. 11A, the light-emitting unit includes nine light-emitting elements E1 to E9, and the light-receiving unit includes nine light-receiving elements D1 to D9.

Figure 12A:
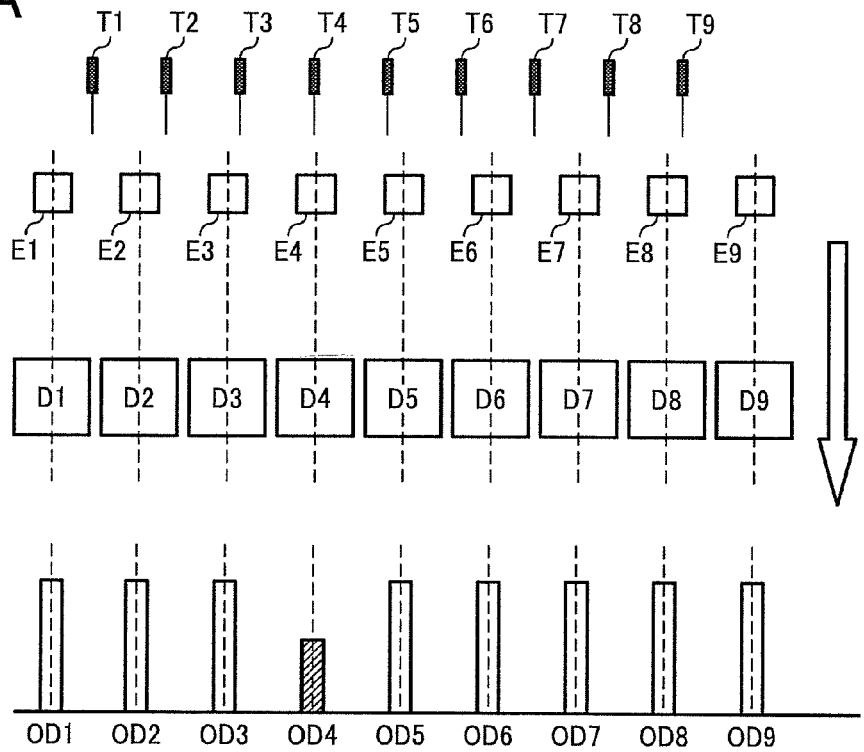
Figure 12B:
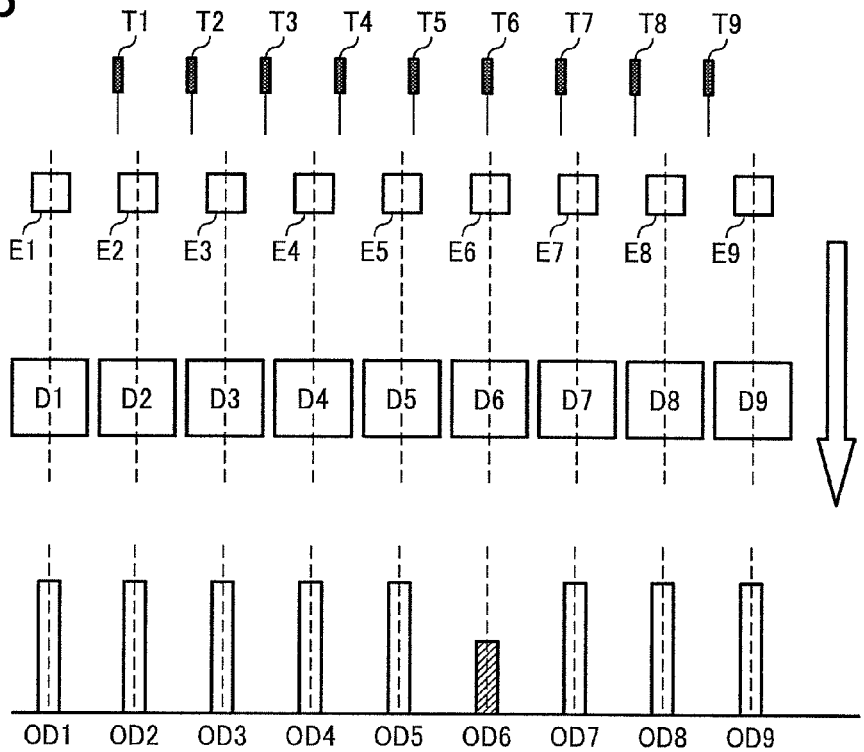

Although the light-emitting elements and the light-receiving elements illustrated in FIGS. 11A, 12A, and 12B are nine, each, several tens to several hundreds of the light-emitting elements and the light-receiving elements are used in practice. To make the drawings simpler, the number of the light-emitting elements and the light-receiving elements is set to nine in the fourteenth embodiment. In other words, the light-emitting elements and the light-receiving elements can be more than nine or less than nine.

The light-emitting elements E1 to E9 emit the detection light. The light-emitting elements E1 to E9 are aligned in a single direction intersecting the sub-direction (i.e., the main-direction (the right-and-left direction in the plane of the paper shown in FIG. 11A) in the fourteenth embodiment) at the pitch EPT in such a manner that nine spots of the detection light are aligned in the main-direction on the supporting member.

The nine light-receiving elements D1 to D9 correspond to the nine light-emitting elements E1 to E9, respectively, in the one-to-one manner. The light-receiving elements D1 to D9 are aligned in a single direction intersecting the sub-direction (i.e., the main-direction in the fourteenth embodiment) at the pitch DPT. That is, each of the light-receiving elements D1 to D9 is in position, opposed to the support member, to receive the detection light reflected from the supporting member and/or the toner pattern, when the corresponding light-emitting element emits the detection light.

The light-emitting unit including the light-emitting elements E1 to E9 and the light-receiving unit including the light-receiving elements D1 to D9 are accommodated in the same housing, thereby forming a reflection-type optical sensor equivalent to the reflection-type optical sensor OS1 illustrated in FIG. 3.

The light-emitting elements E1 to E9 are, for example, LEDs. The light-receiving elements D1 to D9 are, for example, PDs.

If the reflection-type optical sensor is applied to the image forming apparatus illustrated in FIG. 1, the reflection-type optical sensor is arranged under the transfer belt 17.

The pitch EPT of the light-emitting elements E1 to E9 is set equal to the pitch DPT of the light-receiving elements D1 to D9.

The toner pattern includes, as illustrated in FIG. 11A, nine line patterns T1 to T9 having a predetermined shape, aligned in the main-direction at the pitch PT.

The pitch PT is set to K/(K+1), where K=5, i.e., five sixths of the pitch EPT (or the pitch DPT).

As illustrated in FIG. 11A, the light-emitting elements E1 to E9 are aligned in the main-direction on positions corresponding to the light-receiving elements D1 to D9, respectively. When the light-emitting element Ei, where i is an arbitrary integer from 1 to 9, emits the detection light to the surface of the transfer belt as the supporting member, the corresponding light-receiving element Di receives the detection light specularly reflected from the transfer belt.

To make the description simpler, the surface of the transfer belt is assumed to be specular. When the detection light from the light-emitting element Ei strikes the surface of the transfer belt, only the corresponding light-receiving element Di receives the detection light that is specularly reflected from the surface of the transfer belt. When the detection light from the light-emitting element Ei strikes the line pattern of the toner pattern, no light-receiving element Dj other than the light-receiving element Di ($i \neq j$) receives the detection light that is diffusely reflected from the line pattern.

To detect the position of the toner pattern, all the light-emitting elements E1 to E9 simultaneously turn ON/OFF with an intermittent manner, and the amounts of the light received at the light-receiving elements D1 to D9 are analyzed. The intervals between ON and OFF are set, in consideration of the speed at which the transfer belt rotates in the sub-direction, short enough so that the toner pattern is exposed to the detection light without fail.

In the example illustrated in FIG. 11A, the line patterns T1 to T9 are arranged at ideal positions with respect to the arrangement of the light-emitting elements E1 to E9 and the light-receiving elements D1 to D9 in the main-direction. More particularly, the line pattern T5 that is at the center of the line patterns T1 to T9 is aligned with the light-emitting element E5, which is the center of the light-emitting elements E1 to E9, and the light-receiving element D5, which is the center of the light-receiving elements D1 to D9, in the main-direction.

When the toner pattern comes close to the detection area of the reflection-type optical sensor by rotation of the transfer belt as the supporting member in the sub-direction (direction indicated by the arrow illustrated in FIG. 11A), the intermittent ON/OFF operation of the light-emitting elements E1 to E9 starts. Before the toner pattern enters the detection area exposed to the detection light, the detection light is specularly reflected from the surface of the transfer belt, and thus the light-receiving element Di receives the specular reflection light from the light-emitting element Ei.

Figure 11B:
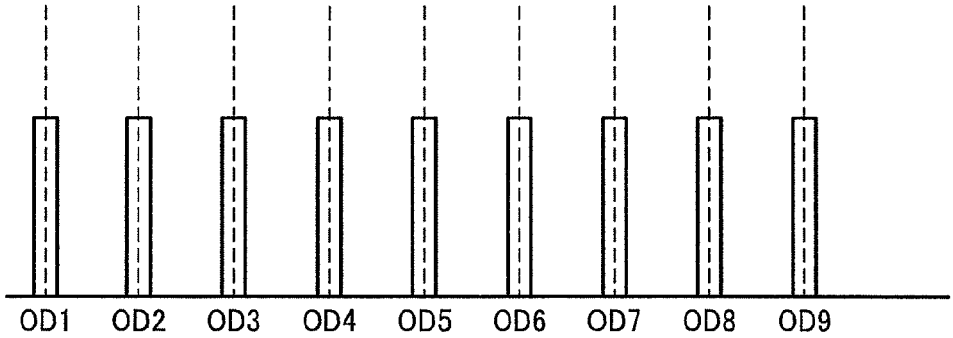

Output values OD1 to OD9 are the amounts of the light received at the light-receiving elements D1 to D9, respectively. Before the toner pattern enters the detection area, the output value OD1 to OD9 are equal as illustrated in FIG. 11B.

When the toner pattern enters the detection area, the spot of the detection light strikes the line pattern. To make the description simpler, it is assumed that the diffuse reflection light is generated only when the line pattern is exposed to the spot of the detection light from the light-emitting element that is located on the position the same as the exposed line pattern in the main-direction.

Figure 11C:
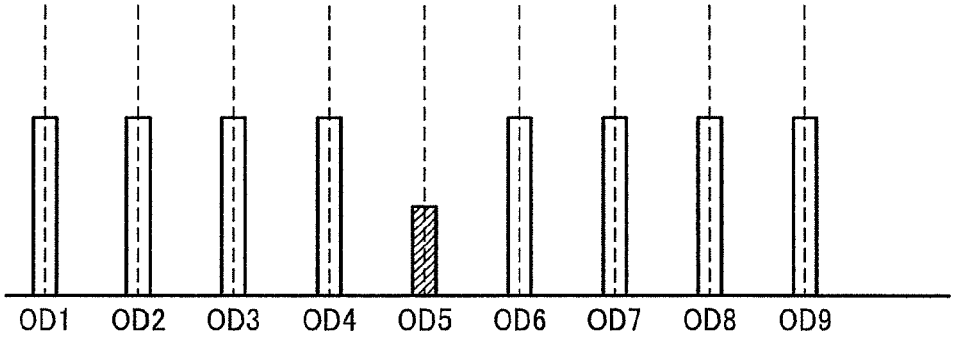

In the example illustrated in FIG. 11A, the spot of the detection light strikes the line pattern T5, and the output values OD1 to OD9 illustrated in FIG. 11C are obtained. It is determined, from the output values OD1 to OD9 illustrated in FIG. 11C, that the line pattern T5 is aligned with the light-emitting element E5 and the light-receiving element D5 in the main-direction. Thus, the position of the toner pattern is detected.

In the ideal position as illustrated in FIG. 11A, the line pattern T5 is at the position aligned with the position of the light-emitting element E5 in the main-direction, while the line patterns T4 and T6 are at positions shifting from those of the light-emitting elements E4 and E6, respectively toward the line pattern T5 by a shift amount ΔT. The shift amount ΔT at the line patterns T4 and T6 is equal to EPT/5.

The line patterns T3 and T7 are at positions shifting from those of the light-emitting elements E3 and E7, respectively toward the line pattern T5 by the shift amount ΔT. The shift amount ΔT at the line patterns T3 and T7 is equal to 2(EPT/5). The line patterns T2 and T8 are at positions shifting from those of the light-emitting elements E2 and E8, respectively toward the line pattern T5 by the shift amount ΔT. The shift amount ΔT at the line patterns T2 and T8 is equal to 3(EPT/5). The line patterns T1 and T9 are at positions shifting from those of the light-emitting elements E1 and E9, respectively toward the line pattern T5 by the shift amount ΔT. The shift amount ΔT at the line patterns T1 and T9 is equal to 4(EPT/5).

Therefore, as a shift amount by which the toner pattern is shifted with respect to the reflection-type optical sensor from the ideal position illustrated in FIG. 11A either rightward or leftward in the main-direction increases, the line patterns other than the line pattern T5 get aligned with the corresponding light-receiving elements one after another with EPT/5 increments. As a result, the output of the light-receiving element aligned with the line pattern marks a value lower than the values of the outputs of the other light-receiving elements.

In the example illustrated in FIG. 12A, the toner pattern is shifted by the shift amount ΔT leftward from the ideal position illustrated in FIG. 11A. As a result, the line pattern T4 is aligned with the light-receiving element D4 in the main-direction. In this case, as it is clear from the output values OD1 to OD9 illustrated at the bottom of FIG. 12A, the output value OD4 is lower than the other output values.

In the example illustrated in FIG. 12B, the toner pattern is shifted by the shift amount ΔT rightward from the ideal position illustrated in FIG. 11A. As a result, the line pattern T6 is aligned with the light-receiving element D6 in the main-direction. In this case, as it is clear from the output values OD1 to OD9 illustrated at the bottom of FIG. 12B, the output value OD6 is lower than the other output values.

In this manner, the position of the toner pattern in the main-direction is detected accurately with increments of one fifth of the pitch of the light-emitting elements and the light-receiving elements.

The above description is made under certain conditions for simplification; therefore, the outputs more complicated than the outputs illustrated in FIGS. 11B, 11C, 12A, and 12B will be obtained in actual cases. Even if the complicated outputs are obtained, the output of the light-receiving element aligned with one of the line patterns T1 to T9 (e.g., the light-receiving element D5, D4, or D6 in the examples illustrated in FIG. 11A, 12A, or 12B) always marks the lowest value from among the output values OA1 to OA9.

Therefore, it is possible to detect the position of the toner pattern by identifying the light-receiving element having the lowest output value.

Figure 13:
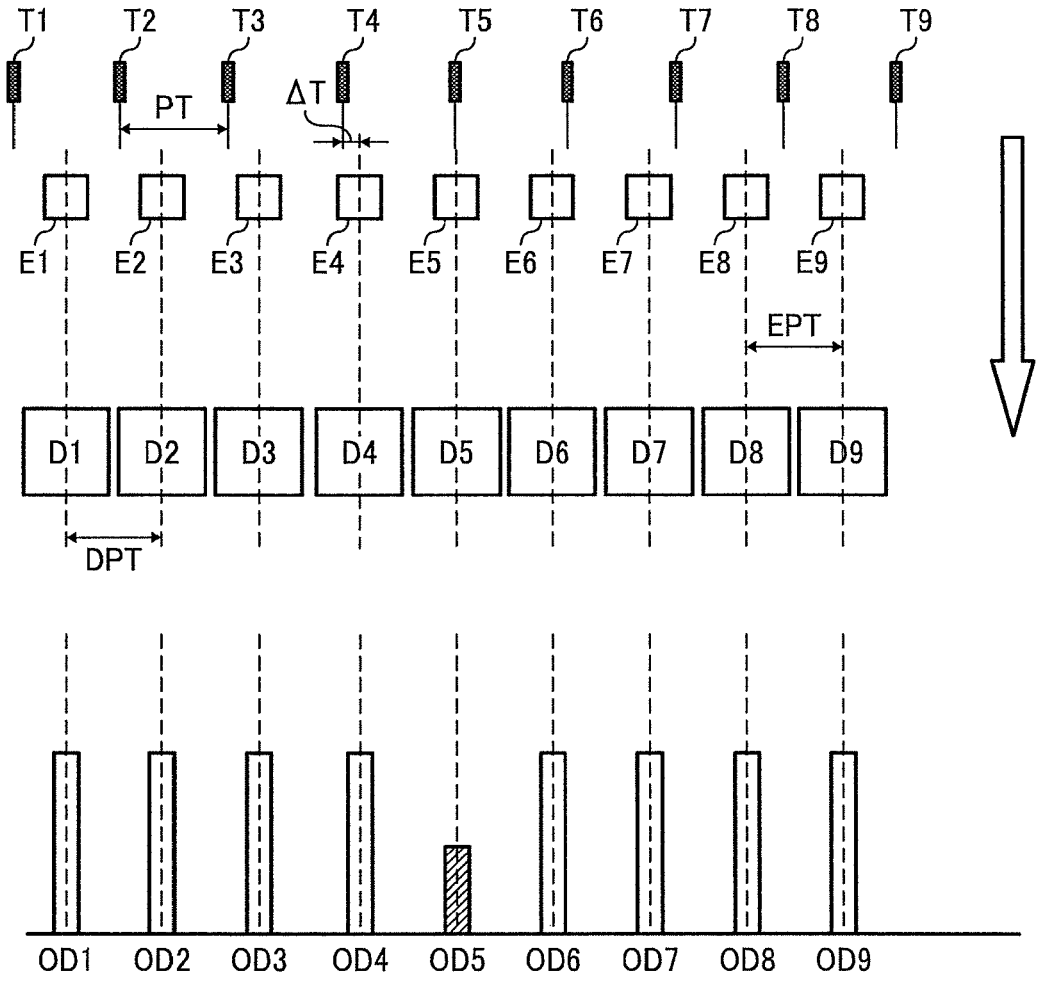
FIGS. 13, 14A, and 14B are schematic diagrams for explaining a method of detecting the position of the toner pattern according to a fifteenth embodiment of the present invention.
Figure 14A:
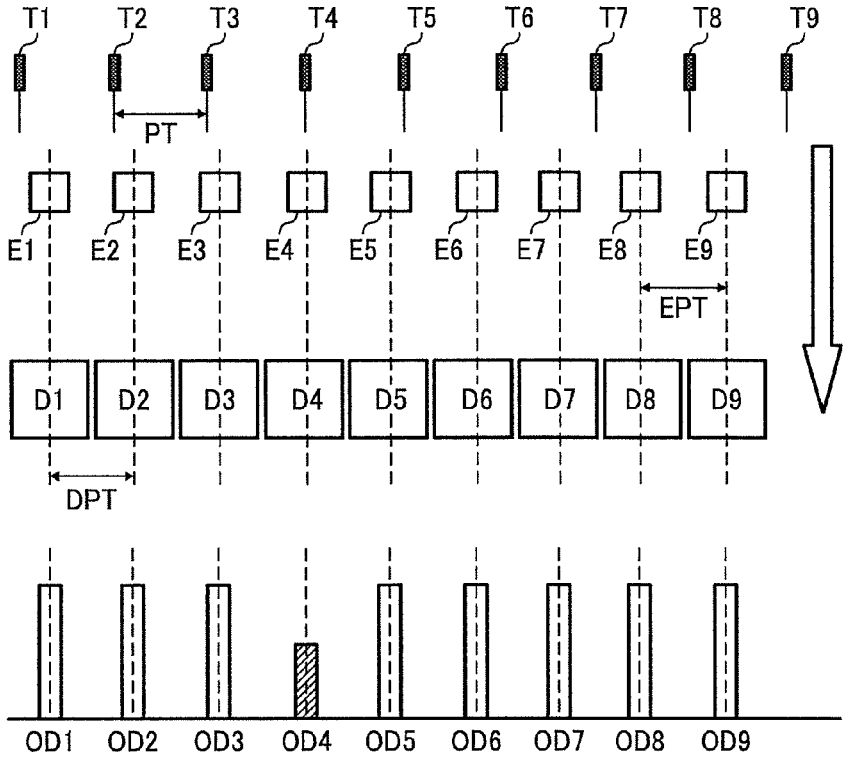
Figure 14B:
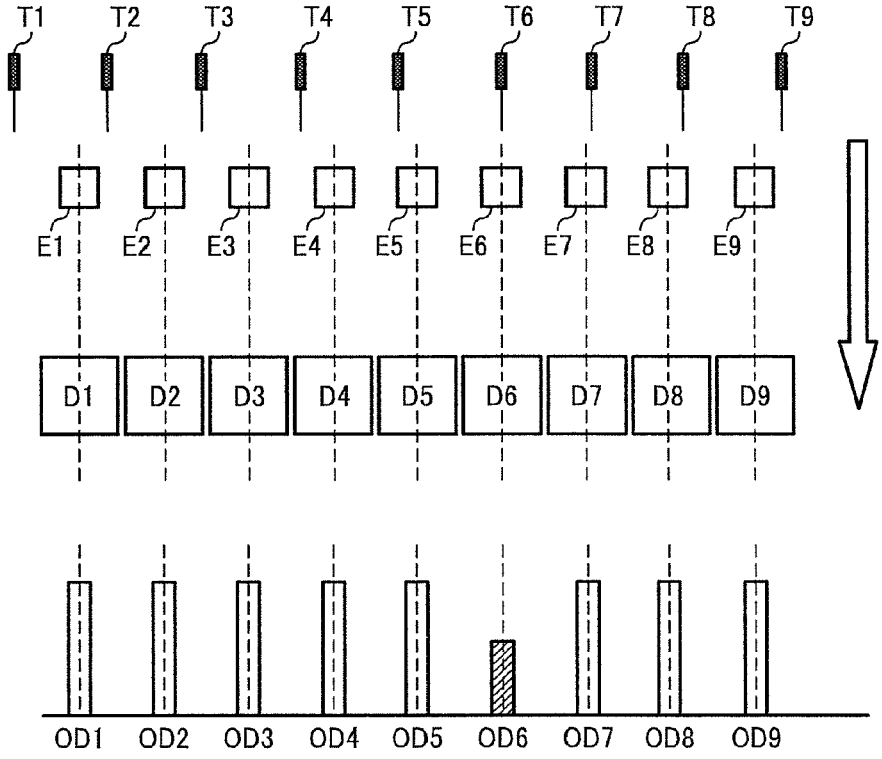

FIGS. 13, 14A, and 14B are schematic diagrams for explaining a method of detecting the position of the toner pattern according to a fifteenth embodiment of the present invention. As there is no concern about confusion, the parts corresponding to those in the fourteenth embodiment are denoted with the same reference numerals for simplification.

As illustrated in FIG. 13, the light-emitting unit includes the light-emitting elements E1 to E9. The light-receiving unit includes the light-receiving elements D1 to D9. To make the drawings simpler, the number of the light-emitting elements and the light-receiving elements is set to 9 in the fifteenth embodiment. In other words, the light-emitting elements and the light-receiving elements can be more than nine or less than nine.

The light-emitting elements E1 to E9 and the light-receiving elements D1 to D9 in the fifteenth embodiment are the same as those in the fourteenth embodiment described with reference to FIG. 11A to FIG. 12C. The light-emitting elements E1 to E9 are aligned in a single direction intersecting the sub-direction (i.e., the main-direction (the right-and-left direction in the plane of the paper shown in FIG. 13) in the fifteenth embodiment) at the pitch EPT. The light-receiving elements D1 to D9 are aligned in a single direction intersecting the sub-direction (i.e., the main-direction in the fifteenth embodiment) at the pitch DPT. The light-emitting unit and the light-receiving unit are accommodated in the housing, appropriately, thereby forming the reflection-type optical sensor.

The pitch EPT and the pitch DPT are set equal to each other. If the light-emitting element Ei and the light-receiving element Di, where i is an arbitrary integer from 1 to 9, are arranged in such a manner that the light-receiving element Di receives, from the light-emitting element Ei, the specular reflection light that is reflected from the surface of the transfer belt, the position of the toner pattern is matched with the position of the light-receiving element Di with respect to the main-direction.

As illustrated in FIG. 13, the toner pattern includes the line patterns T1 to T9. The pitch PT between adjacent ones of the line patterns T1 to T9 in the main-direction is set to (K+1)/K, where K is 5, i.e., six fifths of the pitch EPT (or the pitch DPT).

In the same manner as in the fourteenth embodiment, the light-emitting elements E1 to E9 are aligned in the main-direction on positions corresponding to the light-receiving elements D1 to D9, respectively. When the light-emitting element Ei, where i is an arbitrary integer from 1 to 9, emits the detection light to the surface of the transfer belt as the supporting member, the corresponding light-receiving element Di receives the detection light specularly reflected from the transfer belt.

To make the description simpler, the surface of the transfer belt is assumed to be specular. When the detection light from the light-emitting element Ei strikes the surface of the transfer belt, only the corresponding light-receiving element Di receives the detection light that is specularly reflected from the surface of the transfer belt. When the detection light from the light-emitting element Ei strikes the line pattern of the toner pattern, no light-receiving element Dj other than the light-receiving element Di ($i \neq j$) receives the detection light that is diffusely reflected from the line pattern.

To detect the position of the toner pattern, in the same manner as in the fourteenth embodiment, all the light-emitting elements E1 to E9 simultaneously turn ON/OFF with an intermittent manner, and the amounts of the light received at the light-receiving elements D1 to D9 are analyzed.

In the example illustrated in FIG. 13, the line patterns T1 to T9 are arranged at ideal positions with respect to the arrangement of the light-emitting elements E1 to E9 and the light-receiving elements D1 to D9 in the main-direction. More particularly, the line pattern T5 that is at the center of the line patterns T1 to T9 is aligned with the light-emitting element E5, which is the center of the light-emitting elements E1 to E9, and the light-receiving element D5, which is the center of the light-receiving elements D1 to D9, in the main-direction.

When the toner pattern comes close to the detection area of the reflection-type optical sensor by rotation of the transfer belt as the supporting member in the sub-direction (direction indicated by the arrow illustrated in FIG. 13A), the intermittent ON/OFF operation of the light-emitting elements E1 to E9 starts. Before the toner pattern enters the detection area exposed to the detection light, the detection light is specularly reflected from the surface of the transfer belt, and thus the light-receiving element Di receives the specular reflection light from the light-emitting element Ei.

Before the toner pattern enters the detection area, the output value OD1 to OD9 are equal as illustrated in FIG. 11B.

When the toner pattern enters the detection area, the spot of the detection light strikes the line pattern. To make the description simpler, it is assumed that the diffuse reflection light is generated only when the line pattern is exposed to the spot of the detection light from the light-emitting element that is located on the position the same as the exposed line pattern in the main-direction.

In the example illustrated in FIG. 13, the spot of the detection light strikes the line pattern T5, and the output values OD1 to OD9 illustrated at the bottom of FIG. 13 are obtained. It is determined, from the output values OD1 to OD9, that the line pattern T5 is aligned with the light-emitting element E5 and the light-receiving element D5 in the main-direction. Thus, the position of the toner pattern is detected.

In the ideal position as illustrated in FIG. 13, the line pattern T5 is at the position aligned with the position of the light-emitting element E5 in the main-direction, while the line patterns T4 and T6 are at positions shifting from those of the light-emitting elements E4 and E6, respectively away from the line pattern T5 by the shift amount ΔT. The shift amount ΔT at the line patterns T4 and T6 is equal to EPT/5.

The line patterns T3 and T7 are at positions shifting from those of the light-emitting elements E3 and E7, respectively away from the line pattern T5 by the shift amount ΔT. The shift amount ΔT at the line patterns T3 and T7 is equal to 2(EPT/5). The line patterns T2 and T8 are at positions shifting from those of the light-emitting elements E2 and E8, respectively away from the line pattern T5 by the shift amount ΔT. The shift amount ΔT at the line patterns T2 and T8 is equal to 3(EPT/5). The line patterns T1 and T9 are at positions shifting from those of the light-emitting elements E1 and E9, respectively away from the line pattern T5 by the shift amount ΔT. The shift amount ΔT at the line patterns T1 and T9 is equal to 4(EPT/5).

Therefore, as a shift amount by which the toner pattern is shifted with respect to the reflection-type optical sensor from the ideal position illustrated in FIG. 11A either rightward or leftward in the main-direction increases, the line patterns other than the line pattern T5 get aligned with the corresponding light-receiving elements one after another with EPT/5 increments. As a result, the output of the light-receiving element aligned with the line pattern marks a value lower than the values of the outputs of the other light-receiving elements.

In the example illustrated in FIG. 14A, the toner pattern is shifted by the shift amount ΔT rightward from the ideal position illustrated in FIG. 13. As a result, the line pattern T4 is aligned with the light-receiving element D4 in the main-direction. In this case, as it is clear from the output values OD1 to OD9 illustrated at the bottom of FIG. 14A, the output value OD4 is lower than the other output values.

In the example illustrated in FIG. 14B, the toner pattern is shifted by the shift amount ΔT leftward from the ideal position illustrated in FIG. 13. As a result, the line pattern T6 is aligned with the light-receiving element D6 in the main-direction. In this case, as it is clear from the output values OD1 to OD9 illustrated at the bottom of FIG. 14B, the output value OD6 is lower than the other output values.

In this manner, the position of the toner pattern in the main-direction is detected accurately with increments of one fifth of the pitch of the light-emitting elements and the light-receiving elements.

The above description is made under certain conditions for simplification; therefore, the outputs more complicated than the outputs illustrated in FIGS. 13, 14A, and 14B will be obtained in actual cases. As described in the fourteenth embodiment with reference to FIG. 11A to FIG. 12B, even if the complicated outputs are obtained, the output of the light-receiving element aligned with one of the line patterns T1 to T9 (e.g., the light-receiving element D5, D4, or D6 in the examples illustrated in FIG. 13, 14A, or 15B) always marks the lowest value from among the output values OA1 to OA9. Therefore, it is possible to detect the position of the toner pattern by identifying the light-receiving element having the lowest output value.

In the fourteenth embodiment and the fifteenth embodiment, as described with reference to FIG. 11A to FIG. 14B, a left-most limit of the detectable shift amount is a position where the line pattern T5 is aligned with the light-receiving element D4; and a right-most limit of the detectable shift amount is a position where the line pattern T5 aligned with the light-receiving element D6.

In other words, in the methods according to the fourteenth embodiment and the fifteenth embodiment, the position of the toner pattern is detectable if the shift amount is within a range twice as large as the pitch EPT (or the pitch DPT).

The size of the range in the main-direction within which the toner pattern is detectable (hereinafter, "detectable range") is directly proportional to the pitch EPT or the pitch DPT. The accuracy of the detection is directly proportional to the value of K in K/(K+1) or (K+1)/K defining the pitch PT. As the value of K increases, the number of the light-emitting elements and the light-receiving elements and the number of the line patterns increases.

It is clear from the above description that, in the methods according to the fourteenth embodiment and the fifteenth embodiment, M, which is the number of the light-emitting elements in the phrase the light-emitting elements and "the light-receiving elements or the corresponding light-receiving elements" corresponding thereto, is equal to "the number of the light-receiving elements or the corresponding light-receiving elements"; N, which is the number of the light-receiving elements in the phrase the light-receiving elements and the corresponding light-receiving elements corresponding thereto is equal to the number of the corresponding light-emitting elements.

Under this assumption, in the fourteenth embodiment and the fifteenth embodiment, the detectable range becomes the largest, i.e., twice as large as the pitch EPT or the pitch DPT when the number of the line patterns as the toner pattern is equal to M, which is the number of the light-emitting elements or the number of the corresponding light-emitting elements, or N, which is the number of light-receiving elements or the corresponding light-receiving elements. The detectable range decreases as the number of the line patterns decreases with the accuracy 1/K.

If the direction in which the toner pattern can shift is restricted or the shift amount is limited, it is possible to decrease the number of the light-emitting elements, the light-receiving elements, and the line patterns. For example, if the toner pattern illustrated in FIG. 11A can shift within a range the left side of the line pattern T5, the reflection-type optical sensor can be formed with only the light-emitting elements E1 to E5 and the light-receiving elements D1 to D5 and the toner pattern can be formed with only the line patterns T1 to T5.

In this manner, the position of the toner pattern in the main-direction is calculated from the position of the light receiving element having the lowest output and the ideal positional relation among the toner patterns, the light-emitting elements, and the light-receiving elements.

In the fourteenth embodiment and the fifteenth embodiment illustrated in FIG. 11A to FIG. 14B, the line patterns as the toner pattern are aligned in the main-direction; however, the line patterns can be aligned in a direction inclined to the main-direction.

The light-emitting elements and the light-receiving elements are aligned in the main-direction; however, they can be aligned in another manner as illustrated in FIG. 4 or 5. Although an example is explained above in which all the light-emitting elements are turned ON/OFF simultaneously, it is allowable to turn ON the light-emitting elements one after another, sequentially from one arranged on an end.

A method of detecting the position of the toner pattern according to a sixteenth embodiment of the present invention is described with reference to FIGS. 15A to 15C.

As there is no concern about confusion, the parts corresponding to those in the fourteenth embodiment are denoted with the same reference numerals for simplification.

In the sixteenth embodiment, the light-emitting unit includes the light-emitting elements E1 to E4. The light-receiving unit includes the light-receiving elements D1 to D4. The light-emitting unit and the light-receiving unit are accommodated in the housing, appropriately, thereby forming the reflection-type optical sensor. The reflection-type optical sensor is arranged opposed to the surface of the transfer belt as the supporting member. The right-and-left direction in the plane of the paper shown in FIGS. 15A to 15C corresponds to the main-direction. The light-emitting elements and the light-receiving elements are aligned in the main-direction at the equal pitch (i.e., EPT=DPT).

The toner pattern includes the two line patterns T1 and T2 aligned in the main-direction.

Figure 15A:
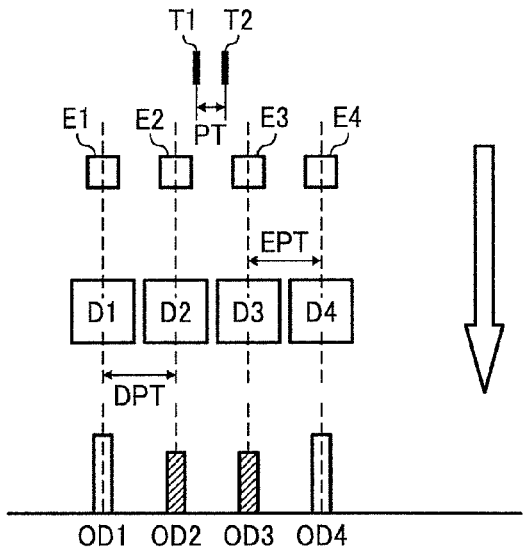
FIGS. 15A to 15C are schematic diagrams for explaining a method of detecting the position of the toner pattern according to a sixteenth embodiment of the present invention.
Figure 15B:
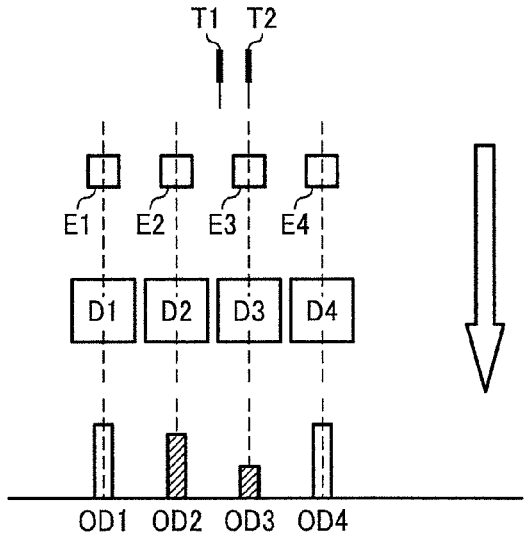
Figure 15C:
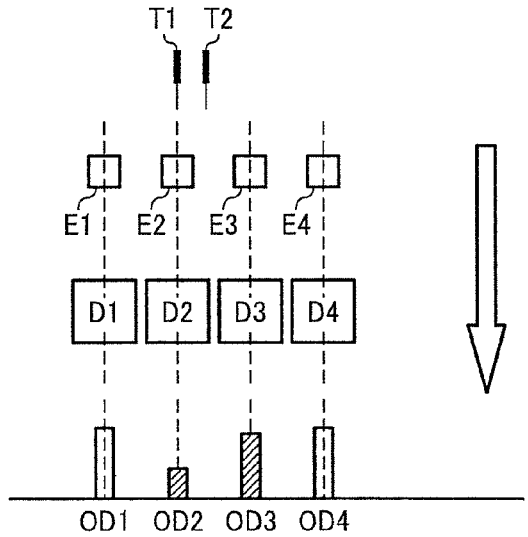

In the example illustrated in FIGS. 15A to 15C, the pitch PT between the line patterns T1 and T2 is a half of the pitch EPT of the light-emitting elements E1 to E4.

The light-emitting elements E1 to E4 are aligned in the main-direction on positions corresponding to the light-receiving elements D1 to D4, respectively. When the light-emitting element Ei, where i is an arbitrary integer from 1 to 4, emits the detection light to the surface of the transfer belt as the supporting member, the corresponding light-receiving element Di receives the detection light specularly reflected from the transfer belt.

The light-emitting elements emit the detection light in such a manner that adjacent spots of the detection light formed on the surface of the transfer belt are slightly overlapped, so that the areas that are exposed to the spots make a single area continuous in the main-direction.

To make the description simpler, it is assumed that when the detection light strikes the line pattern, the detection light is diffusely reflected, and the light-receiving element corresponding to the light-emitting element that emits the detection light receives the diffuse reflection light.

To detect the position of the toner pattern, both the light-emitting elements E1 and E2 are turned ON/OFF simultaneously, and the amounts of the light received at the light-receiving elements D1 and D2 are compared.

In the example illustrated in FIG. 15A, the line patterns T1 and T2 are formed at ideal positions in the main-direction. When the toner pattern illustrated in FIG. 15A is exposed to the detection light, the line pattern T1 is exposed to the spot of the detection light emitted from the light-emitting element E2, and the diffuse reflection light enters the light-receiving element D2.

The line pattern T2 is exposed to the spot of the detection light emitted from the light-emitting element E3, and the diffuse reflection light enters the light-receiving element D3.

As a result, the output values OD1 to OD4 illustrated at the bottom of FIG. 15A are obtained as the outputs of the light-receiving elements D1 to D4.

In the example illustrated in FIG. 15B, the toner pattern is shifted by a quarter of the pitch EPT rightward in the main-direction from the ideal position as illustrate in FIG. 15A.

When the toner pattern illustrated in FIG. 15B is exposed to the detection light, the line pattern T I is exposed to the spots of the detection light emitted from the light-emitting elements E2 and E3, and the diffuse reflection light enters the light-receiving elements D2 and D3.

The line pattern T2 is exposed to the spot of the detection light emitted from the light-emitting element E3, and the diffuse reflection light enters the light-receiving element D3.

As a result, the output values OD1 to OD4 illustrated at the bottom of FIG. 15B are obtained as the outputs of the light-receiving elements D1 to D4.

In the example illustrated in FIG. 15C, the toner pattern is shifted by a quarter of the pitch EPT left leftward in the main-direction from the ideal position as illustrate in FIG. 15A.

When the toner pattern illustrated in FIG. 15C is exposed to the detection light, the line pattern T1 is exposed to the spot of the detection light emitted from the light-emitting element E2, and the diffuse reflection light enters the light-receiving elements D2.

The line pattern T2 is exposed to the spots of the detection light emitted from the light-emitting elements E2 and E3, and the diffuse reflection light enters the light-receiving elements D2 and D3.

As a result, the output values OD1 to OD4 illustrated at the bottom of FIG. 15C are obtained as the outputs of the light-receiving elements D1 to D4.

Therefore, the position of the toner pattern in the main-direction is calculated accurately with the increments of a quarter of the pitch EPT from the difference among the output values OD1 to OD4 illustrated in FIGS. 15A to 15C.

In the example illustrated in FIGS. 15A to 15C, because the light-emitting elements and the light-receiving elements are four, each, even when the position of the toner pattern is shifted in the right-and-left direction, i.e., the main-direction further more within thrice as large as the pitch EPT, the position of the toner pattern is detectable. Even if the light-emitting elements E1 and E4 and the light-receiving elements D1 and D4 are removed from the reflection-type optical sensor illustrated in FIGS. 15A to 15C, the position of the toner pattern in the main-direction is detectable within a range equal to the pitch of the remaining light-emitting elements and the remaining light-receiving elements.

In the sixteenth embodiment illustrated in FIG. 15A to 15C, the toner patterns are aligned in the main-direction; however, it is allowable to align the line patterns T1 and T2 as the toner pattern in a direction inclined to the main-direction.

The light-emitting elements and the light-receiving elements are aligned in the main-direction; however, they can be aligned in another manner as illustrated in FIG. 4 or 5. Although an example is explained above in which all the light-emitting elements are turned ON/OFF simultaneously, it is allowable to turn the light-emitting elements ON one after another, sequentially from one arranged on an end.

The pitch PT between the line patterns T1 and T2 can be set to a value half-integer times as large as the pitch EPT. The number of the line patterns can be set to three or larger.

Figure 6C:
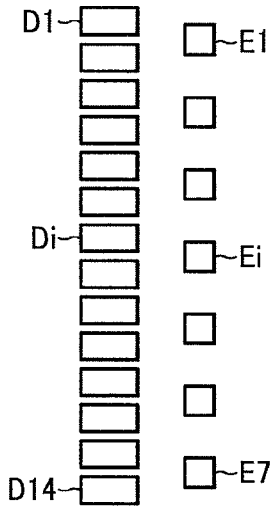
FIG. 6C is a schematic diagram of an arrangement of light-emitting elements and light-receiving in a reflection-type optical sensor according to a seventh embodiment of the present invention.

In the fourteenth embodiment to the sixteenth embodiment illustrated in FIG. 11A to FIG. 15C, the number of the light-emitting elements forming the light-emitting unit and the number of the light-receiving elements forming the light-receiving unit are equal; however, it is possible to perform the methods of detecting the position of the toner pattern according to the fourteenth embodiment to the sixteenth embodiment by using even the light-emitting elements and the light-receiving elements having unequal numbers, for example, those illustrated in FIGS. 6B and 6C as the reflection-type optical sensor.

Moreover, it is possible to perform the methods of detecting the position of the toner pattern according to the fourteenth embodiment to the sixteenth embodiment by using the light-emitting elements and the light-receiving elements illustrated in FIG. 6A as the reflection-type optical sensor.

As described above, according to one aspect of the present invention, there are provided a method of detecting a position of a toner pattern, a reflection-type optical sensor used in the method, and an image forming apparatus that performs the method by using the reflection-type optical sensor.

Furthermore, according to another aspect of the present invention, because the toner pattern is detected in a short time, an operating efficiency of a main activity, i.e., image formation is improved. Moreover, an amount of toner to be consumed for the toner pattern is suppressed.

Moreover, according to still another aspect of the present invention, even if the reflection-type optical sensor including less light-emitting elements and less light-receiving elements arranged at a large pitch between adjacent ones of the light-emitting elements and the light-receiving elements is used, the position of the toner pattern can be detected accurately.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A method of detecting a position of a toner pattern in an image forming apparatus including a light-emitting unit that includes M number of light-emitting elements aligned in a single direction intersecting a first direction, where M is equal to or larger than three, and emits a detection light such that M number of light spots fall on a supporting member that makes a surface movement in the first direction with a distance between adjacent light spots in a second direction perpendicular to the first direction on the supporting member equal to or smaller than a length of a toner pattern in the second direction and a light-receiving unit that includes N number of light-receiving elements that receive a reflected light from at least one of the supporting member and the toner pattern, where N is equal to or larger than three, and aligned opposed to the supporting member in a single direction corresponding to the light-emitting units, the method comprising:

forming the toner pattern on a surface of the supporting member;

emitting the detection light onto the supporting member with the light-emitting unit;

receiving a reflected light reflected from at least one of the supporting member and the toner pattern with the light-receiving unit; and detecting the position of the toner pattern on the supporting member based on outputs of the light-receiving elements.

2. The method according to claim 1, wherein the length of the toner pattern in the second direction is shorter than an area to be exposed to the detection light in the second direction, and the emitting includes emitting the detection light sequentially from the M number of light-emitting elements within a scanning time in which the toner pattern passes through the area to be exposed to the detection light in the first direction.

3. The method according to claim 1, wherein the length of the toner pattern is shorter than an area to be exposed to the detection light in the second direction, a light-emitting/light-receiving group is formed with m number of the light-emitting elements and n number of the light-receiving elements, where m and n are equal to or larger than three, and light-emitting unit includes P number of light-emitting/light-receiving groups, where P is equal to or larger than two, arranged in a direction parallel to or intersecting the second direction, and the emitting includes emitting the detection light sequentially from corresponding light-emitting elements simultaneously in each of the light-emitting/light-receiving groups within a scanning time in which the toner pattern passes through the area to be exposed to the detection light in the first direction.

4. An optical sensor for detecting a position of a toner pattern in an image forming apparatus, the optical sensor comprising:

a light-emitting unit that includes M number of light-emitting elements aligned in a single direction which can be turned on and off individually or simultaneously, where M is equal to or larger than three, such that at least three of said light-emitting elements are aligned in said single direction, and wherein said light-emitting unit emits a detection light onto a supporting member that makes a surface movement in a first direction on which a toner pattern is formed; and a light-receiving unit that includes N number of light-receiving elements that receive a reflected light from at least one of the supporting member and the toner pattern, where N is equal to or larger than three, and aligned opposed to the supporting member in a single direction corresponding to the light-emitting units.

5. The optical sensor according to claim 4, wherein the single direction in which the light-emitting elements are aligned and the single direction in which the light-receiving elements are aligned are substantially parallel to a second direction that is perpendicular to the first direction.

6. The optical sensor according to claim 4, wherein when detecting the position of the toner pattern, the single direction in which the light-emitting elements are aligned and the single direction in which the light-receiving elements are aligned are inclined to the second direction at a predetermined angle according to a movement speed of the supporting member in the first direction.

7. The optical sensor according to claim 4, wherein the light-emitting elements and the light-receiving elements are aligned in a plurality of lines in the single direction, and wherein said optical sensor is configured to detect the position of the toner pattern, while each of the lines is shifted in the first direction by a predetermined shift amount according to a movement speed of the supporting member in the first direction.

8. The optical sensor according to claim 4, wherein a light-emitting/light-receiving group is formed with m number of the light-emitting elements and n number of the light-receiving elements, where m and n are equal to or larger than three, and light-emitting unit includes P number of light-emitting/light-receiving groups, where P is equal to or larger than two, arranged in a single direction on a same line or in parallel, and when detecting the position of the toner pattern, P number of light-emitting elements in the p number of light-emitting/light-receiving groups are turned on and off simultaneously and sequentially.

9. The optical sensor according to claim 4, wherein one light-emitting element corresponds to a plurality of light-receiving elements.

10. The optical sensor according to claim 4, wherein one light-receiving element corresponds to a plurality of light-emitting elements.

11. The optical sensor according to claim 4, further comprising at least one of an emitting optical system that guides the detection light toward the supporting member in a convergent manner and a receiving optical system that guides the reflected light toward the light-receiving unit in a convergent manner.

12. An image forming apparatus that forms an image with toner, the image forming apparatus comprising an optical sensor according to claim 4.

13. The image forming apparatus according to claim 12, wherein the image is at least one of a multi-color image or a full color image using toners of a plurality of colors, and the optical sensor detects the position of each of the toner pattern for each of the colors.

* * * * *